US007448556B2

(12) United States Patent
Muehlhausen et al.

(10) Patent No.: US 7,448,556 B2
(45) **Date of Patent: *Nov. 11, 2008**

(54) DISPENSER BOTTLE FOR AT LEAST TWO ACTIVE FLUIDS

(75) Inventors: Hans-Georg Muehlhausen, Duesseldorf (DE); Paul-Otto Weltgen, Hilden (DE); Ronald Menke, Mettmann (DE); Thomas Jungmann, Neuss (DE)

(73) Assignee: Henkel KGaA, Düsseldorf (DE)

( * ) Notice: Subject to any disclaimer, the term of this patent is extended or adjusted under 35 U.S.C. 154(b) by 345 days.

This patent is subject to a terminal disclaimer.

(21) Appl. No.: 11/058,928

(22) Filed: Feb. 16, 2005

(65) Prior Publication Data

US 2005/0139608 A1 Jun. 30, 2005

Related U.S. Application Data

(63) Continuation of application No. PCT/EP03/09135, filed on Aug. 18, 2003.

(30) Foreign Application Priority Data

Aug. 16, 2002 (DE) ..... 102 38 431
Dec. 6, 2002 (DE) ..... 102 57 387

(51) Int. Cl.

| | |
|---|---|
| ***B05B 11/04*** | (2006.01) |
| ***B05B 1/26*** | (2006.01) |
| ***B05B 1/34*** | (2006.01) |
| ***B65D 1/32*** | (2006.01) |
| ***B67D 5/56*** | (2006.01) |

(52) U.S. Cl. ..... 239/306; 239/304; 239/327; 239/543; 222/129

(58) Field of Classification Search ..... 239/306, 239/304, 327, 543, 303, 375, 376, 377, 544, 239/545, 601, 602; 222/129, 206, 215
See application file for complete search history.

(56) References Cited

U.S. PATENT DOCUMENTS 3,158,615 A 11/1964 Dunn et al.
3,269,389 A * 8/1966 Meurer et al. ..... 128/200.14

(Continued)

FOREIGN PATENT DOCUMENTS

CA 2 292 966 6/2000

(Continued)

OTHER PUBLICATIONS

Rompp Lexikon Chemie, vol. 6, 10th Edition, Georg Thieme Verlag, Stuttgart, p. 4533 (1999).

(Continued)

*Primary Examiner*—Darren W Gorman
(74) *Attorney, Agent, or Firm*—Paul & Paul

(57) ABSTRACT

A dispenser bottle having a first receiving container for a first active fluid and at least a second receiving container for a second active fluid, wherein the receiving containers each have a respective outlet for the active fluid and the outlets are arranged adjacently such that the two active fluids can be applied in a common application field of an application region, and wherein the outlets each comprise a respective discharge nozzle, which nozzles are spaced from one another such that the active fluids intermix only after departing the discharge nozzles.

43 Claims, 17 Drawing Sheets

U.S. PATENT DOCUMENTS

| | | | | | |
|---|---|---|---|---|---|
| 4,260,077 | A * | 4/1981 | Schroeder | 222/137 |
| 4,524,009 | A | 6/1985 | Valenty | |
| 4,639,325 | A | 1/1987 | Valenty et al. | |
| 4,668,887 | A | 5/1987 | D'Argouges et al. | |
| 4,773,562 | A | 9/1988 | Gueret | |
| 4,816,553 | A | 3/1989 | Baur et al. | |
| 4,964,539 | A | 10/1990 | Mueller | |
| 4,985,553 | A | 1/1991 | Fuertes et al. | |
| 4,989,758 | A * | 2/1991 | Keller | 222/137 |
| 5,062,550 | A | 11/1991 | Singh | |
| 5,102,016 | A | 4/1992 | Ball et al. | |
| 5,223,245 | A | 6/1993 | Ibrahim et al. | |
| 5,289,950 | A | 3/1994 | Gentile | |
| 5,356,607 | A | 10/1994 | Just | |
| 5,391,324 | A | 2/1995 | Reinhardt et al. | |
| 5,398,846 | A | 3/1995 | Corba et al. | |
| 5,480,718 | A | 1/1996 | Shigemoto et al. | |
| 5,494,488 | A | 2/1996 | Arnoldi et al. | |
| 5,501,814 | A | 3/1996 | Engelskirchen et al. | |
| 5,541,316 | A | 7/1996 | Engelskirchen et al. | |
| 5,580,941 | A | 12/1996 | Krause et al. | |
| 5,720,983 | A | 2/1998 | Malone | |
| 5,739,091 | A | 4/1998 | Kiesser et al. | |
| 5,744,439 | A | 4/1998 | Bonett | |
| 5,821,360 | A | 10/1998 | Engelskirchen et al. | |
| 5,830,956 | A | 11/1998 | Stockhausen et al. | |
| 5,873,494 | A * | 2/1999 | Dallas, Jr. | 222/129 |
| 5,911,909 | A | 6/1999 | Coyle-Rees | |
| 5,921,440 | A | 7/1999 | Maines | |
| 5,959,101 | A | 9/1999 | Engelskirchen et al. | |
| 5,972,239 | A | 10/1999 | Coyle-Rees | |
| 5,972,873 | A | 10/1999 | Nielsen et al. | |
| 6,187,055 | B1 | 2/2001 | Kottwitz et al. | |
| 6,247,617 | B1 | 6/2001 | Clyde et al. | |
| 6,283,316 | B1 | 9/2001 | Sherman | |
| 6,288,015 | B1 | 9/2001 | Moeller et al. | |
| 6,341,716 | B1 | 1/2002 | Goettner et al. | |
| 6,362,154 | B1 | 3/2002 | Moeller et al. | |
| 6,419,783 | B1 * | 7/2002 | Rainey et al. | 156/297 |
| 6,423,573 | B1 | 7/2002 | Gidon | |
| 6,440,924 | B1 | 8/2002 | Jeschke et al. | |
| 6,521,584 | B1 | 2/2003 | Soldanski et al. | |
| 6,541,233 | B1 | 4/2003 | Hillen et al. | |
| 6,685,041 | B1 * | 2/2004 | Geisinger | 215/6 |
| 6,689,223 | B1 | 2/2004 | Meine et al. | |
| 6,758,411 | B2 * | 7/2004 | Conway et al. | 239/303 |
| 2004/0026535 | A1 * | 2/2004 | Conway et al. | 239/433 |
| 2004/0102349 | A1 | 5/2004 | Breves et al. | |
| 2004/0235125 | A1 | 11/2004 | Kottwitz et al. | |
| 2004/0259222 | A1 | 12/2004 | Breves et al. | |
| 2005/0003504 | A1 | 1/2005 | Weber et al. | |
| 2005/0003985 | A1 | 1/2005 | Kottwitz et al. | |
| 2005/0009167 | A1 | 1/2005 | Weber et al. | |
| 2005/0026269 | A1 | 2/2005 | Kottwitz et al. | |

FOREIGN PATENT DOCUMENTS

| | | | |
|---|---|---|---|
| CA | 2 320 536 | | 3/2001 |
| CA | 2 320 541 | | 3/2001 |
| CA | 2 320 544 | | 3/2001 |
| DE | 690 16 44 | | 12/1968 |
| DE | 32 30 693 | A1 | 3/1984 |
| DE | 37 29 491 | A1 | 3/1988 |
| DE | 40 11 071 | A1 | 11/1990 |
| DE | 43 00 772 | A1 | 1/1994 |
| DE | 42 21 381 | C1 | 2/1994 |
| DE | 93 15 583 | U1 | 5/1994 |
| DE | 43 03 320 | A1 | 8/1994 |
| DE | 43 21 275 | A1 | 1/1995 |
| DE | 690 16 488 | T2 | 6/1995 |
| DE | 44 17 734 | A1 | 11/1995 |
| DE | 195 40 086 | A1 | 4/1997 |
| DE | 195 47 957 | A1 | 7/1997 |
| DE | 196 00 018 | A1 | 7/1997 |
| DE | 196 50 537 | A1 | 6/1998 |
| DE | 198 11 386 | | 9/1999 |
| DE | 198 11 387 | A1 | 9/1999 |
| DE | 198 59 774 | A1 | 6/2000 |
| DE | 198 59 778 | A1 | 6/2000 |
| DE | 198 59 799 | A1 | 6/2000 |
| DE | 198 59 808 | A1 | 6/2000 |
| DE | 199 36 727 | A1 | 2/2001 |
| DE | 199 45 503 | A1 | 4/2001 |
| DE | 199 45 505 | A1 | 4/2001 |
| DE | 199 45 506 | A1 | 4/2001 |
| DE | 100 24 251 | A1 | 11/2001 |
| DE | 100 62 045 | A1 | 6/2002 |
| DE | 100 60 096 | A1 | 7/2002 |
| DE | 101 31 441 | A1 | 1/2003 |
| DE | 101 21 463 | A1 | 2/2003 |
| DE | 101 37 047 | A1 | 2/2003 |
| DE | 101 38 753 | A1 | 3/2003 |
| DE | 101 49 719 | A1 | 4/2003 |
| DE | 101 53 792 | A1 | 5/2003 |
| DE | 101 62 727 | A1 | 7/2003 |
| DE | 101 62 728 | A1 | 7/2003 |
| DE | 101 63 883 | A1 | 7/2003 |
| DE | 101 63 884 | A1 | 7/2003 |
| DE | 102 15 602 | A1 | 10/2003 |
| EP | 0 080 748 | B1 | 7/1985 |
| EP | 0 080 223 | B1 | 7/1986 |
| EP | 0 126 505 | B1 | 1/1987 |
| EP | 0 159 930 | B1 | 6/1988 |
| EP | 0 165 514 | B1 | 8/1988 |
| EP | 0 028 865 | B2 | 3/1989 |
| EP | 0 232 202 | B1 | 9/1991 |
| EP | 0 280 223 | B1 | 10/1991 |
| EP | 0 472 042 | A1 | 2/1992 |
| EP | 0 378 262 | B1 | 12/1993 |
| EP | 0 378 261 | B1 | 7/1994 |
| EP | 0 495 808 | B1 | 1/1995 |
| EP | 0 427 349 | B1 | 7/1995 |
| EP | 0 583 534 | B1 | 3/1997 |
| EP | 0 497 337 | B1 | 6/1997 |
| EP | 0 656 058 | B1 | 12/1997 |
| EP | 0 533 239 | B1 | 4/1998 |
| EP | 0 542 496 | B1 | 5/1998 |
| EP | 0 727 448 | B1 | 6/1998 |
| EP | 1 074 607 | A1 | 2/2001 |
| EP | 0 807 156 | B1 | 3/2001 |
| EP | 0 703 292 | B1 | 4/2001 |
| EP | 0 911 616 | B1 | 8/2001 |
| EP | 0 965 268 | B1 | 3/2003 |
| EP | 1 115 619 | B1 | 3/2003 |
| EP | 0 780 466 | B2 | 1/2005 |
| GB | 2 293 157 | A | 3/1996 |
| JP | 05-339896 | | 12/1993 |
| JP | 07-315448 | | 5/1995 |
| JP | 08-198344 | | 6/1996 |
| WO | WO 91/02792 | A1 | 3/1991 |
| WO | WO 91/04923 | A1 | 4/1991 |
| WO | WO 91/08171 | A1 | 6/1991 |
| WO | WO 92/18542 | A1 | 10/1992 |
| WO | WO 92/19707 | A1 | 11/1992 |
| WO | WO 92/21760 | A1 | 12/1992 |
| WO | WO 93/00418 | A1 | 1/1993 |
| WO | WO 93/08251 | A1 | 4/1993 |
| WO | WO 93/16110 | A1 | 8/1993 |
| WO | WO 94/15465 | A1 | 7/1994 |
| WO | WO 94/28030 | A1 | 12/1994 |
| WO | WO 95/07303 | A1 | 3/1995 |
| WO | WO 95/12619 | A1 | 5/1995 |
| WO | WO 95/12655 | A1 | 5/1995 |
| WO | WO 95/16023 | A1 | 6/1995 |

| | | | |
|---|---|---|---|
| WO | WO 95/20608 | A1 | 8/1995 |
| WO | WO 95/23221 | A1 | 8/1995 |
| WO | WO 96/12648 | A1 | 5/1996 |
| WO | WO 96/31589 | A1 | 10/1996 |
| WO | WO 96/34902 | A2 | 10/1996 |
| WO | WO 97/05227 | A1 | 2/1997 |
| WO | WO 97/14804 | A1 | 4/1997 |
| WO | WO 97/18287 | A1 | 5/1997 |
| WO | WO 97/23087 | A2 | 6/1997 |
| WO | WO 98/13459 | A1 | 4/1998 |
| WO | WO 98/13460 | A1 | 4/1998 |
| WO | WO 98/13462 | A1 | 4/1998 |
| WO | WO 98/21308 | A2 | 5/1998 |
| WO | WO 99/06573 | A1 | 2/1999 |
| WO | WO 99/47634 | A1 | 9/1999 |
| WO | WO 99/47635 | A2 | 9/1999 |
| WO | WO 00/06465 | A1 | 2/2000 |
| WO | WO 00/11713 | A1 | 3/2000 |
| WO | WO 00/39267 | A1 | 7/2000 |
| WO | WO 00/39268 | A1 | 7/2000 |
| WO | WO 00/39269 | A1 | 7/2000 |
| WO | WO 00/39270 | A1 | 7/2000 |
| WO | WO 00/61712 | A1 | 10/2000 |
| WO | WO 00/651713 | A1 | 10/2000 |
| WO | WO 01/10996 | A1 | 2/2001 |
| WO | WO 01/21753 | A1 | 3/2001 |
| WO | WO 01/21754 | A1 | 3/2001 |
| WO | WO 01/21755 | A1 | 3/2001 |
| WO | WO 02/10356 | A2 | 2/2002 |
| WO | WO 02/22467 | A1 | 3/2002 |
| WO | WO 02/44314 | A1 | 6/2002 |
| WO | WO 02/44350 | A2 | 6/2002 |
| WO | WO 02/48308 | A1 | 6/2002 |
| WO | WO 02/074658 | A1 | 9/2002 |

OTHER PUBLICATIONS

A. G. Gornall et al., J. Biol. Chem. vol. 177, pp. 751-766 (1948).
J. Biochem, Microbiol. Technol. Engineer, vol. III, pp. 51-63 (1961).

* cited by examiner

DISPENSER BOTTLE FOR AT LEAST TWO ACTIVE FLUIDS

CROSS REFERENCE TO RELATED APPLICATIONS

This application is a continuation under 35 U.S.C. § 365(c) and 35 U.S.C. § 120 of international application PCT/EP2003/009135, filed Aug. 18, 2003, and claims priority under 35 U.S.C. § 119 of DE 102 38 431.2, filed Aug. 16, 2002 and DE 102 57 387.5, filed Dec. 6, 2002, all of which are incorporated herein by reference in their entirety.

BACKGROUND OF THE INVENTION

The invention relates to a dispenser bottle with at least two receiving containers for active fluids thus able to be stored separately from one another, with the features of the introductory part of claim 1.

The use of active fluids which are to be or must be stored separately from one another is known from some fields of use, particularly in the area of cleaning of surfaces. These active fluids are to meet one another only shortly before or during application to the application region, for example a floor, the surface of a toilet bowl, etc. Examples of such are bleaching, cleaning, decalcifying and disinfecting agents containing chlorine (for example, WO 98/21308 A2). Active fluids of the kind in question are also applied to, for example, bathroom surfaces or in other hygienically sensitive areas.

Active fluids are stored in different receiving containers particularly when they are not stable in storage in common with one another. However, other reasons are also known for separate storage of active fluids which have to be applied in common, for example different colorations which are to communicate different functions of the active fluids, different sensitivity to light, etc.

The dispenser bottle for at least two different active fluids not stable in storage with one another, from which the invention proceeds (WO 98/21308 A2 and U.S. Pat. No. 5,398,846 A), comprises a bottle which has two chambers separate from one another and forming the receiving containers and which is provided at the upper end with directly adjacent outlets for the active fluids in the two receiving containers. A first aqueous solution is disposed in one receiving container and a second aqueous solution in the second receiving container. The concentration of the components in the two aqueous solutions is in that case selected so that when a specific quantity of the first aqueous solution is mixed with a specific quantity of the second aqueous solution the acidic bleaching solution desired in this state of the art is the result.

The disclosure content of the two afore-mentioned prior-published specifications is included, by reference, in the disclosure content of the present patent application.

The dispenser bottle of the state of the art explained above and forming the starting point comprises a pump device that can be placed on the outlets of the two receiving containers of the dispenser bottle. The active fluids are led together in the pump device and expelled from a discharge nozzle in a common spray jet. The active fluids are thus intermixed before they leave the discharge nozzle.

A similar dispenser bottle in which cross-contamination between the two receiving containers can be substantially securely avoided is similarly known (WO 91/04923 A1; DE 690 16 44 T2). No pump spray device is provided in this dispenser bottle, but the outlets are simply open and provided with spouts and can be closed again by a closure cap. This dispenser bottle is not, however, suitable for a spray application.

In spite of that, for constructional details the disclosure content of these prior-published specifications is also inducted, by reference, into the disclosure content of the present patent application.

A dispenser bottle for an active fluid with a receiving container of flexible plastics material and a discharge nozzle is known for, in particular, cleaning of lavatory bowls (EP 0 911 616 B1), wherein for optimum application of the active fluid in the toilet bowl, particularly under the inner edge thereof, the discharge nozzle is constructed as an angled dosing tube.

In the case of washing agents in liquid form, particularly when they contain water, due to chemical incompatibility of the individual ingredients negative interactions of these ingredients between one another and a decrease in their activity and thus a decrease in the washing capability of the agent overall can happen even when there is only relatively short storage. This decline in activity in principle concerns all washing agent ingredients which undergo chemical reactions in the washing process in order to contribute to the washing result, particularly bleaching agents and enzymes, although also surface-active or sequestration ingredients responsible for dissolving processes or complexing steps are not unlimitedly stable in storage particularly in the presence of the mentioned chemically reactive ingredients in aqueous systems. A possible way out results, for example, from the fact that the reactivity of the chemically active ingredients is not of the same degree for all pH values, so that through appropriate setting of the pH value of the agent the harmful action of an ingredient or its degradation reaction can be minimised. However, a difficulty then results due to the fact that the minimum of the reactivity of the chemically active ingredients does not lie at the same pH value and therefore stabilisation by way of the pH value is normally not possible for all ingredients at the same time. A further difficulty results from the fact that the pH value lying as close as possible to the reactivity minimum during storage has to change under conditions of use of the agent so that the reactivity of the chemically active ingredients can be higher under washing conditions and they are thereby shifted into a position of being able to make their contribution to the washing result.

For resolving this problem it has been variously proposed in the state of the art not to introduce all washing agent ingredients, which are desirable for a good washing result, into a liquid washing agent at the same time, but to make available to the washing agent user several components which the user is to combine only shortly before or during the washing process and each contain only mutually compatible ingredients and which are to be used together under use conditions.

Thus, there is known from International Patent Application WO 00/11713 A1 a liquid washing agent which consists of at least two liquid part compositions, wherein the active fluids are kept separately from one another in a container with at least two chambers (receiving containers) and of which at least one comprises an imine or oxaziridine bleach activator and at least one other comprises an alkalising agent, wherein at least one of the part compositions contains a per-oxygen bleaching agent and each part composition has a pH value leading to stability. When the part compositions are mixed the pH value of the end composition increases due to the alkalising agent so that bleaching agent and bleach activator effectively react with one another.

A dispenser with two chambers is known from European Patent Specification EP 0 807 156 B1, the first chamber of which contains an aqueous composition of hydrogen peroxide or an organic peracid with a pH value above 2 and below 7 and the second chamber of which contains an acidic component and from which the content is delivered together or in succession onto a surface so that the resulting mixture has a pH value of at most 2.

International Patent Application WO 94/15465 A1 describes a two-pack system of on the one hand an aqueous aliphatic peracid and on the other hand an aqueous hydrogen peroxide solution containing corrosion inhibitor, peracid stabiliser and/or hydrogen peroxide stabiliser. The two solutions are combined to produce a disinfecting agent.

It is proposed in German Patent Application DE 100 24 251 A1 to store appropriately separately in a double-chamber bottle a bleaching agent, which in a first component consists of an aqueous 1 to 40 weight percent aqueous imidoperoxocarboxylic acid dispersion and in a second component of a substance mixture activating the first component, and to mix the two components only at the time of use. The second component, which in this specification is also termed pH-regulating buffer solution, consists of an aqueous solution of sodium hydrogen carbonate and sodium carbonate which has been thickened with the help of methyl cellulose.

The teaching has the object of indicating a dispenser bottle with at least two receiving containers for two active fluids, which can be produced economically and easily handled by a user and in that case allows application of two active fluids separately from one another, but coming together in an application field.

SUMMARY OF THE INVENTION

The object demonstrated in the foregoing is met, in the case of a dispenser bottle with a first receiving container (1) for a first active fluid and at least one, preferably exactly one, second receiving container (2) for a second active cleaning fluid, wherein the two receiving containers (1, 2) are either separately constructed and connected together or constructed integrally with one another and wherein the receiving containers (1, 2) each have a respective outlet (3, 4) for the active fluid and the outlets (3, 4) are arranged adjacent to one another in such a manner that the two active fluids can be applied in a common application field (5) of an application region, characterized in that the outlets (3, 4) are each provided with at least one, preferably with exactly one, respective discharge nozzle (6, 7), which nozzles are spaced from one another so that the active fluids are intermixed only after departure from the discharge nozzle (6, 7).

The receiving containers are preferably constructed as compressible containers. Through compression of the receiving containers by the hand of a user the necessary internal pressure is thus produced within the receiving containers in order to expel the active fluids from the respective, separately provided discharge nozzles. The requisite pressure can also be produced by gravity when the product delivery is to be discharged not upwardly against gravitational force, such as, for example, in a toilet, but downwardly as in the case of application of cleaning agents for floor cleaning or introduction of washing agents into the washing machine. The active fluids thus intermix only after departure from the discharge nozzles in the application field. The desired product to be applied is thereby created from the two active fluids during application, thus, in particular, the cleaning agent, bleaching agent, etc., which develops the desired effect in the field of application.

The claimed dispenser bottle achieves the above-explained result by an approach which is particularly simple in constructional terms and readily manageable, particularly with elimination of a pump spray device. The claimed dispenser bottle is thus best suited for use as a mass product, particularly for cleaning agents of all kind, especially also for cleaning toilets. However, the claimed dispenser bottle can also be employed for a multiplicity of other cases of use, for example for the dosing of textile cleaning agents (washing agent in washing machines, etc.), textile pretreatment agents (bleaching agent, etc.), textile post-treatment agents (softeners, etc.), for the dosing of hand and machine dishwashing agents and dishwashing additives (clear rinsing agents, calcium dissolving agents, etc.) and finally also for the dosing of surface cleaning agents and surface treatment agents of all kinds.

By active fluid in the sense of the teaching of the present patent application there are to be understood all liquid and other flowable media of low-viscosity to high-viscosity through gel-like to pasty substances. Pulverulent and lumpy, such as granulated, active substances can also be applied by the dispenser bottle according to the invention. In that case on the one hand the viscosity of the active fluid or flow capability of the active fluid is of significance for the respective application of interest and on the other hand, and in particular manner, the thixotropy of the active fluid is also of significance (for explanation of the term thixotropy, the phenomenon that specific active fluids liquefy under the action of mechanical forces, but after conclusion of the mechanical loading—in a given case with a considerable delay in time—solidify again, thus have a viscosity dependent on the action of mechanical forces, see RÖMPP, LEXIKON Chemie, 10th Edition, Georg Thieme Verlag, Stuttgart, 1999, Vol. 6, page 4533).

Preferred embodiments and developments of the teaching are the subject of the subclaims.

In that case special and independent significance attaches to an embodiment for which it applies that the shape and the dimensions of the discharge nozzles and the characteristics, particularly the viscosities and/or the thixotropy, of the active fluids are so matched to one another that—in the case of average pressure by the hand of a user or pressure due to gravitational force—the fluid flows come into coincidence in a specific, predetermined distance. A special embodiment then consists in that the nozzle channels of the discharge nozzles are, in fact, oriented to be substantially parallel to one another, but have in each instance a cross-sectional constriction arranged asymmetrically with respect to the total flow cross-section. The cross-sectional constrictions are arranged at the mutually facing sides of the nozzle channels in such a manner that the active fluids issuing under pressure have a twist directed towards one another. This means that due to the subtle form of the discharge nozzles the flows of the active fluids issuing from the discharge nozzles run to a certain extent on a curve towards one another and collide at a somewhat variable spacing from the discharge nozzles depending on the outflow pressure. The application field of the application region can then be disposed there. This embodiment with the cross-sectional constrictions has special significance particularly when the active fluids are substantially identical thixotropic active fluids.

The twist effect is also produced if the openings of the nozzle channels of the discharge nozzles are chamfered relative to one another, i.e. the planes of opening of the nozzle channels are disposed at an angle relative to one another, wherein the section of the wall of the discharge nozzle disposed inwardly relative to the longitudinal axis of the nozzle channel is longer than the section of the wall disposed outwardly relative to the longitudinal axis of the nozzle channel.

Further embodiments and developments are evident moreover from the further subclaims.

BRIEF DESCRIPTION OF THE DRAWINGS

The invention is now explained in more detail in the following by reference to a drawing illustrating merely examples of embodiment, wherein.

DETAILED DESCRIPTION OF THE INVENTION

Figure 1A:
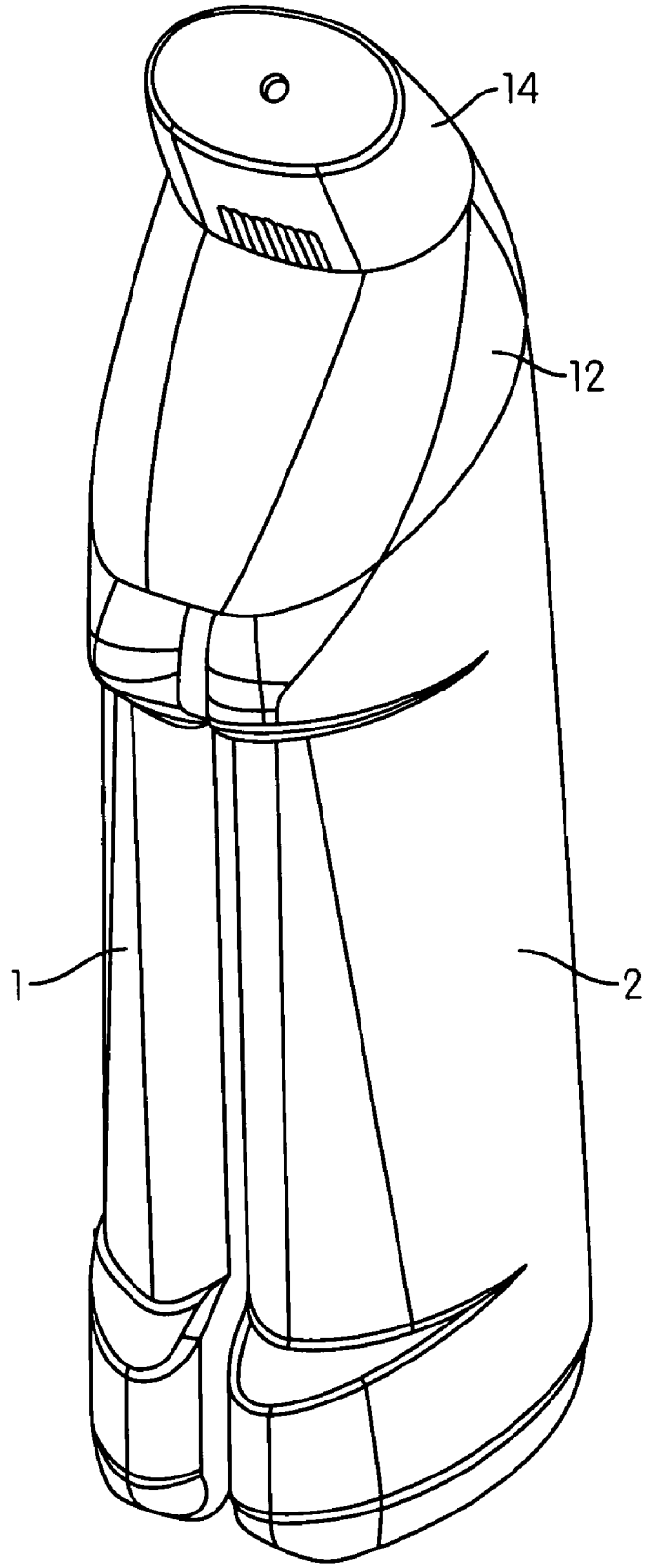
FIG. 1*a* shows, in a perspective view, a first example of embodiment of a dispenser bottle according to the invention.
Figure 1B:
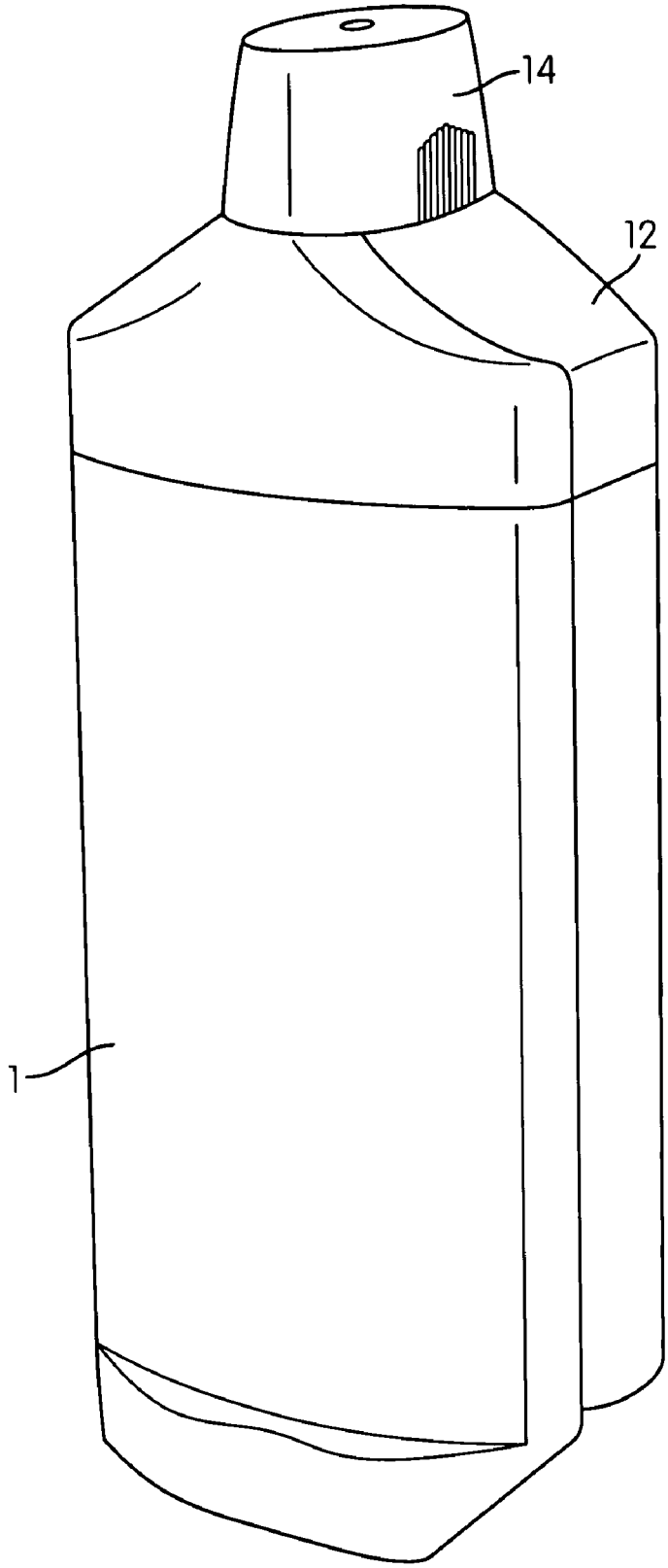
FIG. 1*b* shows, in a perspective view, a second example of embodiment of a dispenser bottle according to the invention.
Figure 2A:
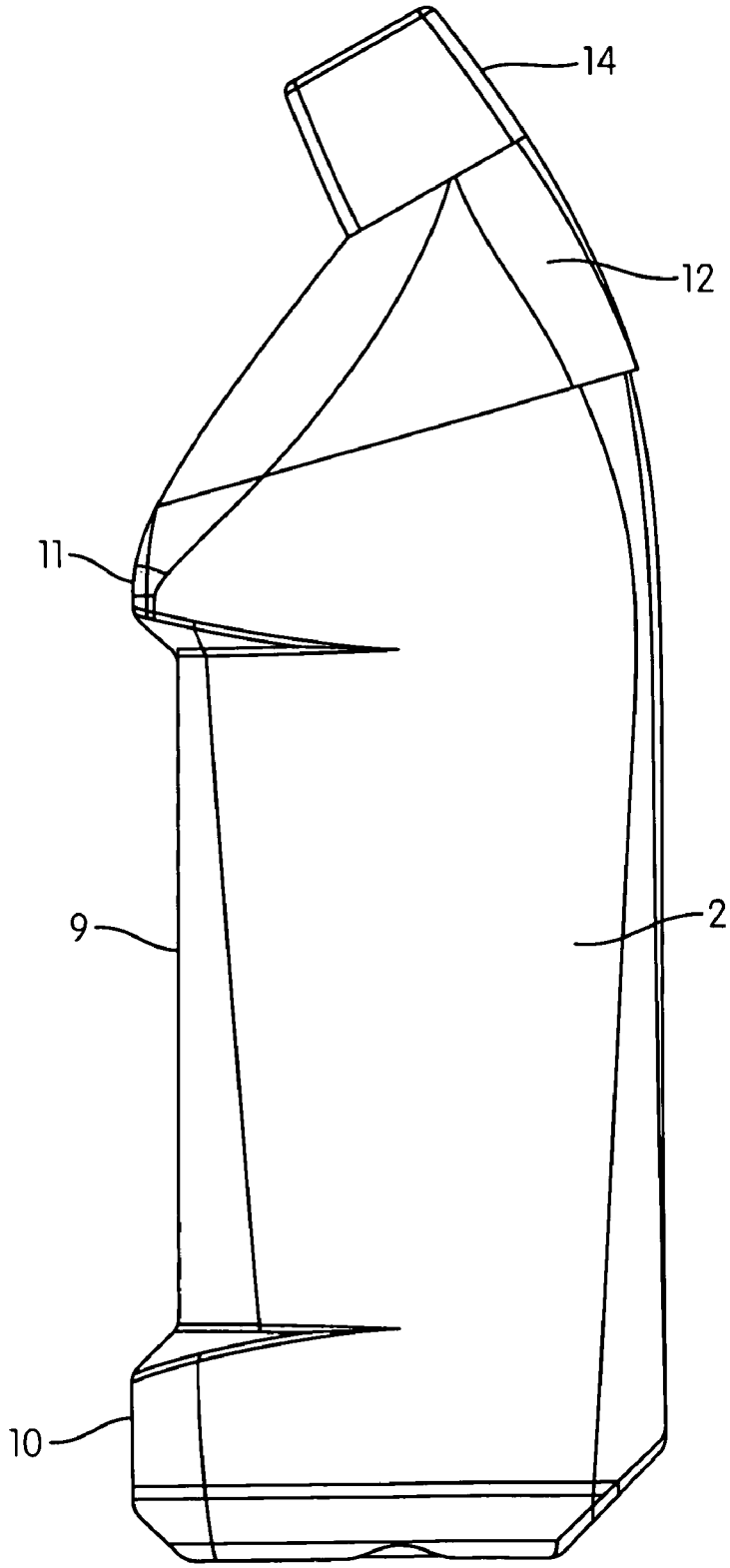
FIG. 2*a* shows the dispenser bottle of FIG. 1*a* as seen from the side.
Figure 2B:
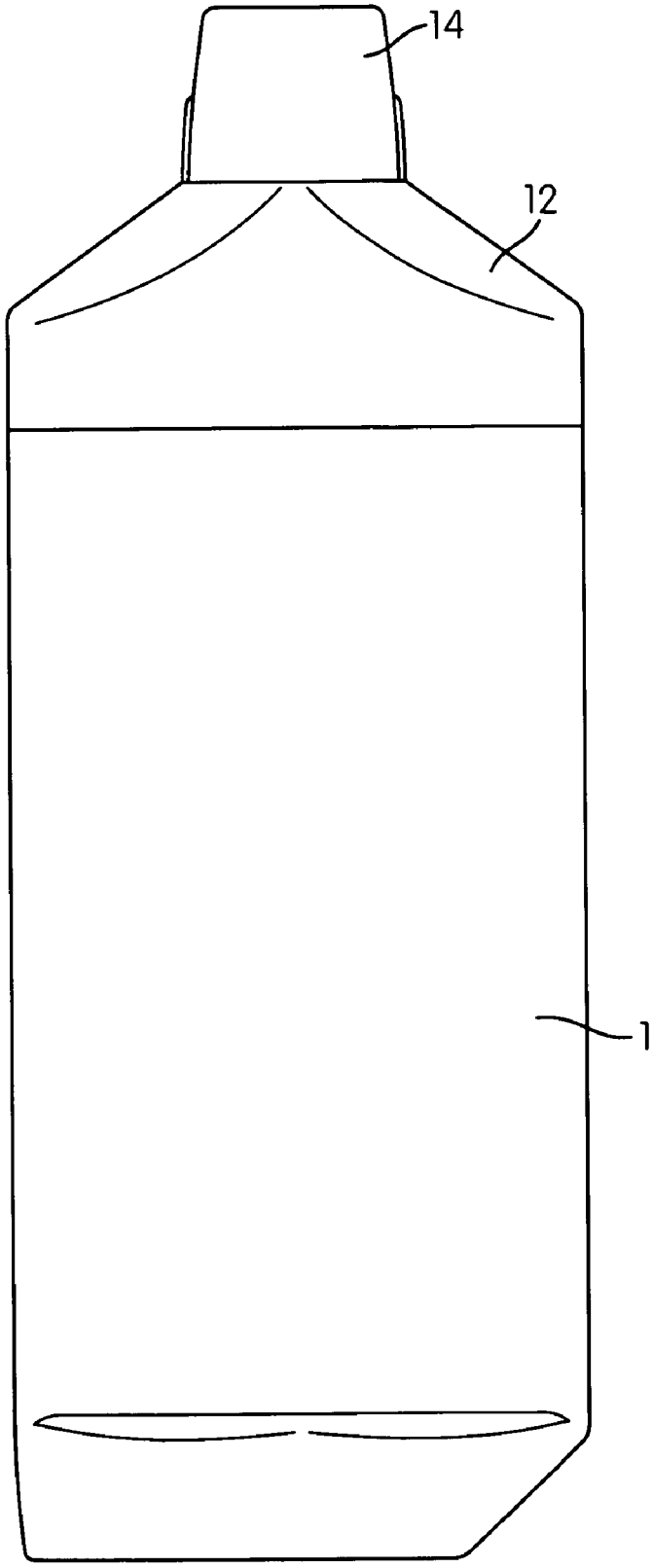
FIG. 2*b* shows the dispenser bottle of FIG. 1*b* as seen from the side.

The subject of the invention is a dispenser bottle as illustrated in FIGS. 1*a* and 1*b* in perspective and in FIGS. 2*a* and 2*b* from the side. There can be seen on the left a first receiving container 1 for a first active fluid and on the right a second receiving container 2 for a second active fluid. Fundamental to the teaching of the invention is that also more than two receiving containers 1, 2 can be provided, for example three receiving containers for three active fluids or even four receiving containers for four active fluids, which are to be combined in the region of application.

Active fluids are frequently active fluids which are not stable in storage together; however, that is not an absolute prerequisite for the teaching of the invention. Reference may be made to the explanations further above. Equally, reference may be made to the explanations further above with respect to the definition of the term 'active fluid' in the sense of this present application and to the specific preferred characteristics of active fluids of that kind.

The two receiving containers 1, 2 are either of separate construction and connected together, for example by gluing or detenting or by another connecting element, or, as in the illustrated example of embodiment, constructed integrally with one another. To that extent reference may be made to the state of the art explained in the introduction for the various variants able to be selected. In practice preference is for a dispenser bottle in which the two receiving containers 1, 2 are constructed integrally with one another. That is further explained later.

Figure 3:
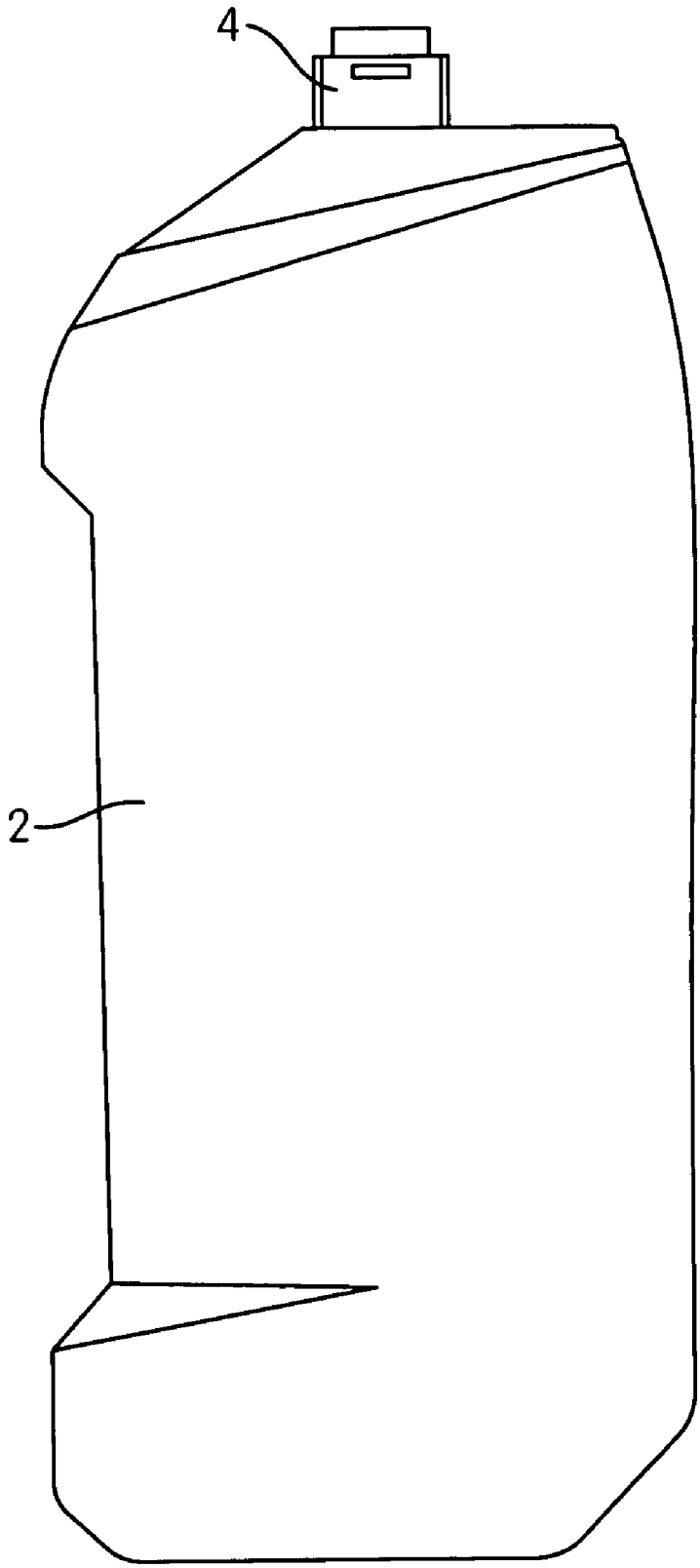
FIG. 3 shows the dispenser bottle of FIG. 1*a* in an illustration corresponding with FIG. 2*a*, but without nozzle head.
Figure 4:
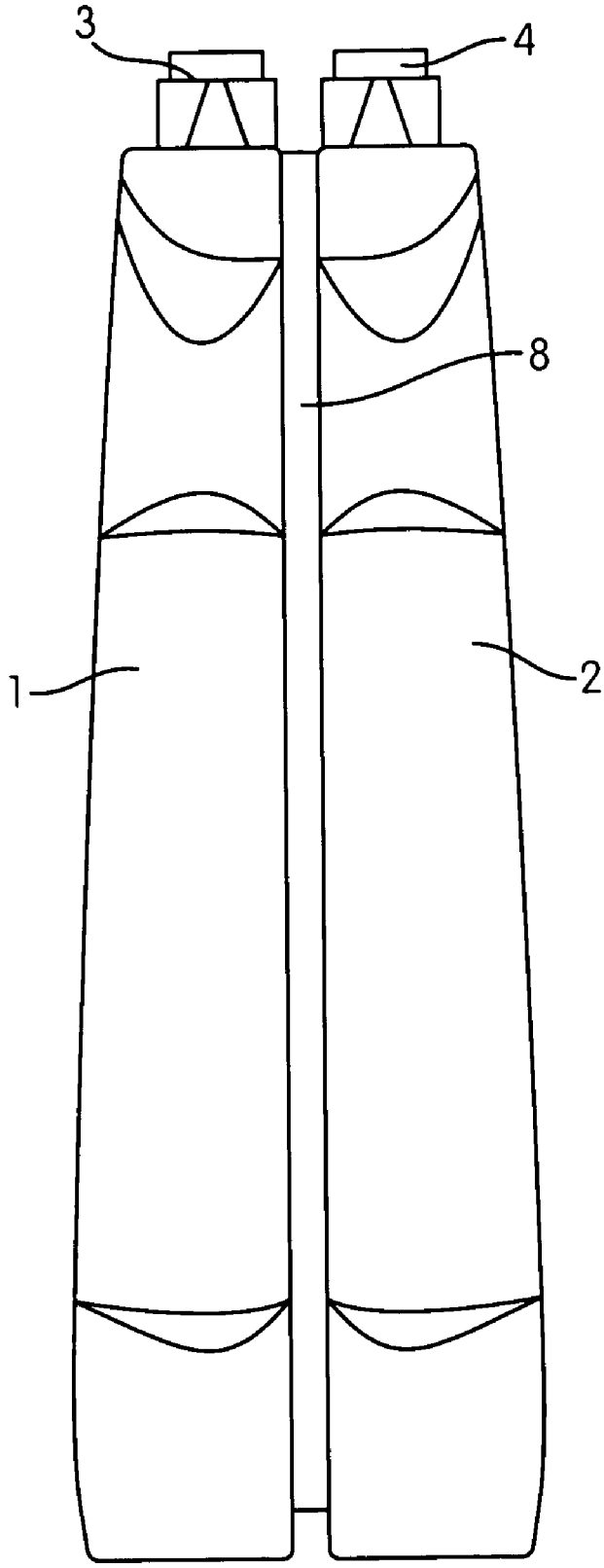
FIG. 4 shows, in an illustration corresponding with FIG. 3, the dispenser bottle in a view of the narrow side.

FIGS. 3 and 4 show the receiving containers 1, 2 for the first form of embodiment of the dispenser bottle according to FIGS. 1*a* and 2*a* separately. It can be seen that the receiving containers each have a respective outlet 3, 4 for the respective active fluid. The outlets 3, 4 are so arranged adjacent to one another that the two active fluids can be applied in a common application field 5, indicated in FIG. 11, of a larger application region. Express reference has been made to the special significance of this external mixing of the active fluids from the two receiving containers 1, 2 in the general part of the description, to which reference may be made. The receiving containers were not separately illustrated for the form of embodiment of the dispenser bottle according to FIGS. 1*b* and 2*b*, the difference being merely that it has no holding region since the application takes place by tipping and the liquid discharge on the basis of gravitational force.

The dispenser bottle according to the invention is always explained in the following on the basis that there are only two receiving containers 1, 2 for two active fluids. The observation explained in the introduction that several receiving containers can also be used must be kept in mind, because the explanation is also applicable to such multi-container dispenser bottles.

Figure 8:
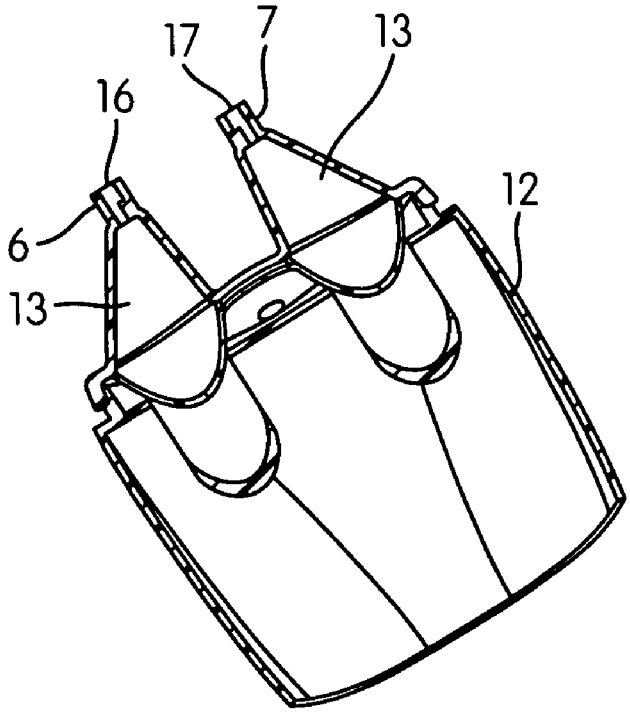
FIG. 8 shows the dosing head of FIG. 7 in section.
Figure 9:
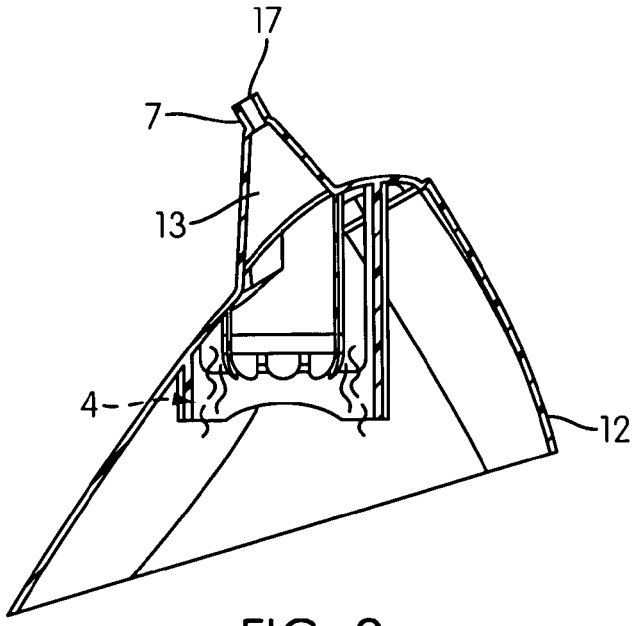
FIG. 9 shows the dosing head of FIG. 7 in section perpendicularly to the section of FIG. 8.
Figure 11A:
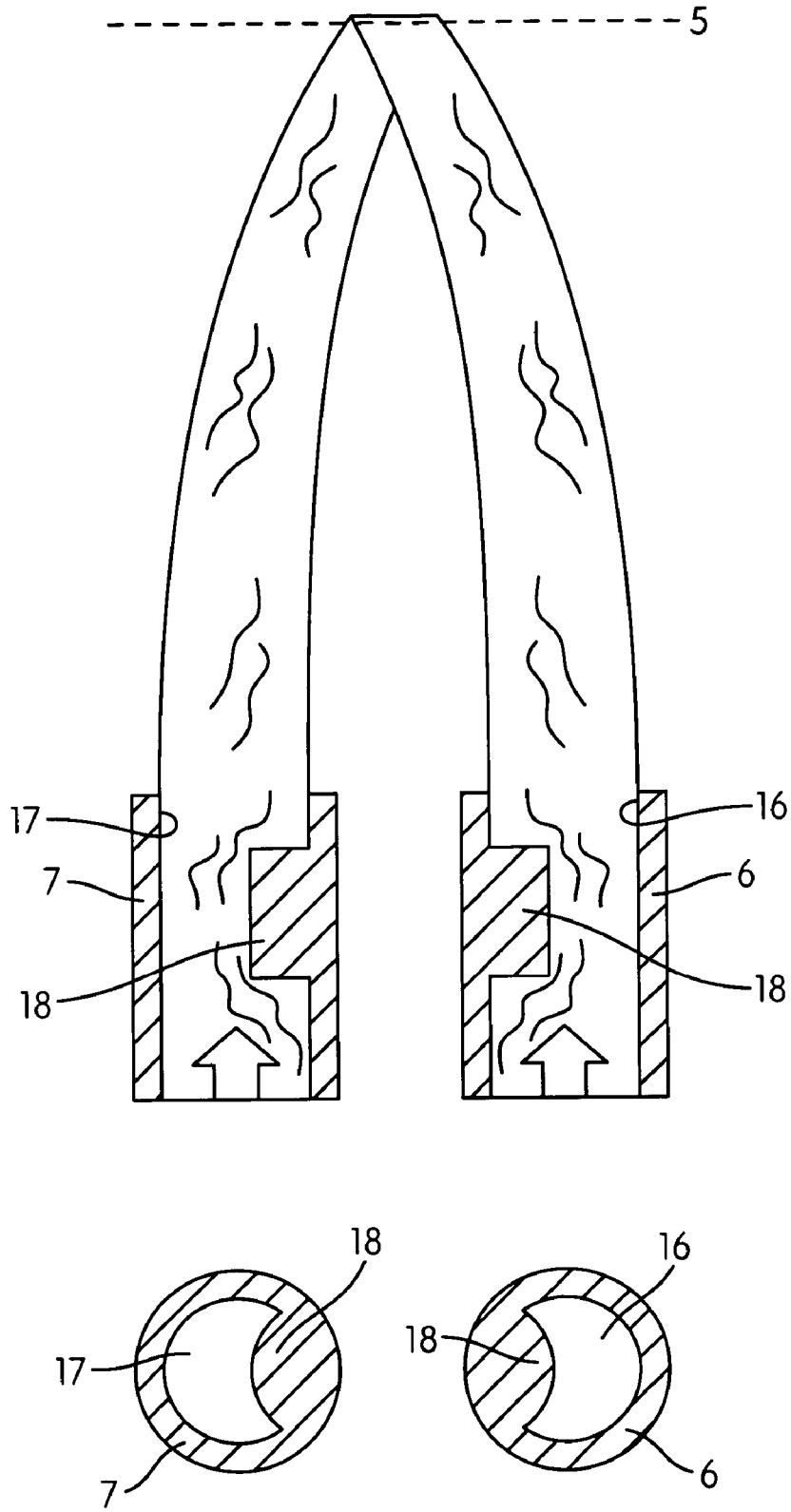
FIG. 11*a* shows the jet pattern of the active fluids in a first example of embodiment of the dispenser bottle according to the invention.
Figure 11B:
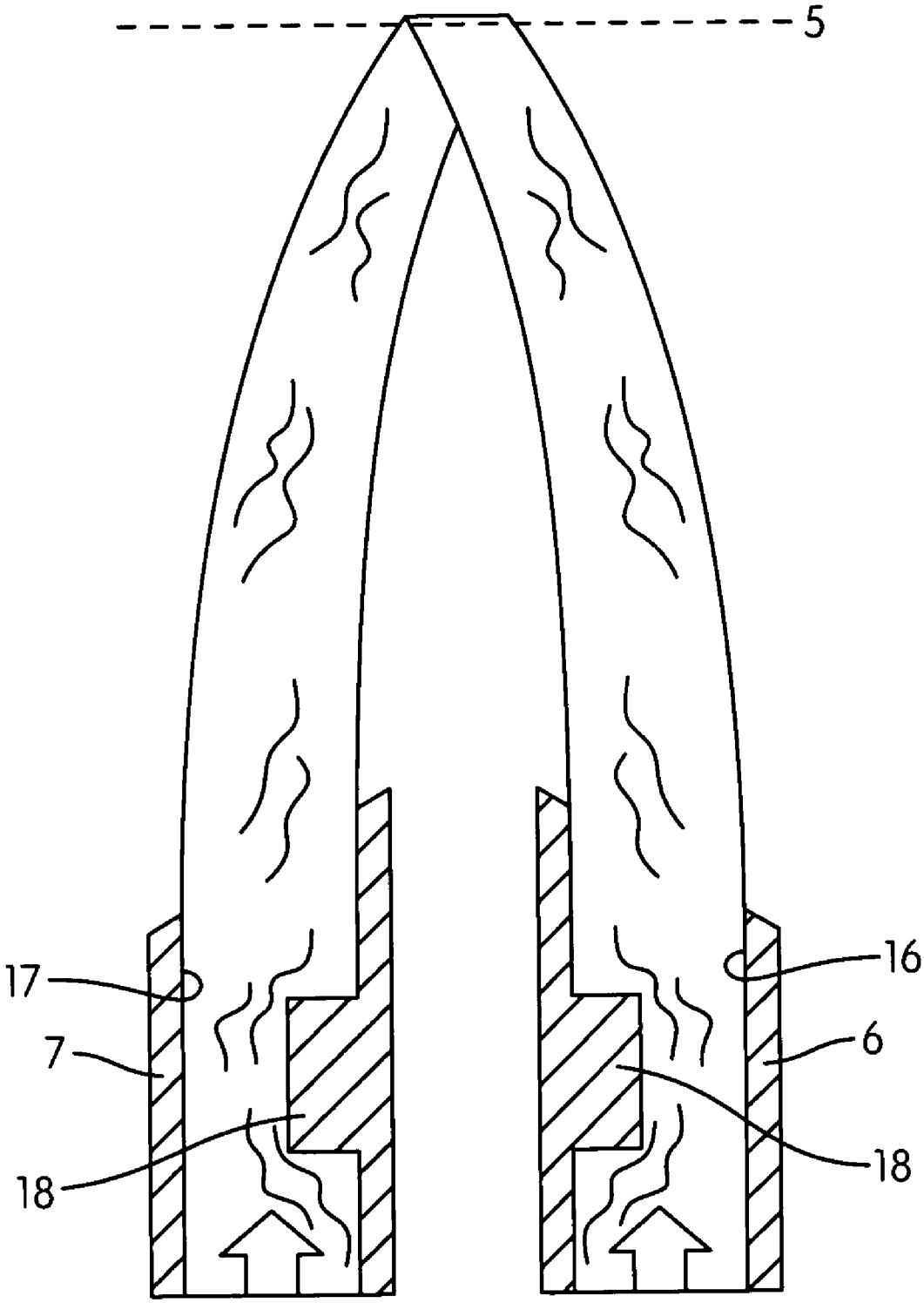
FIG. 11*b* shows the jet pattern of the active fluids in a second example of embodiment of a dispenser bottle according to the invention.

It is essential for the dispenser bottle according to the invention that the receiving containers 1, 2 are each provided with a respective outlet 3, 4 each with, at least one, preferably with precisely one, discharge nozzle 6, 7, so that the active fluids are mixed together only after leaving the discharge nozzles 6, 7. It is additionally essential for the dispenser bottle according to the first form of embodiment (FIG. 1*a*) that the receiving containers 1, 2 are constructed as compressible containers, as they are preferably used for product delivery in opposition to gravitational force, such as for dosing under toilet edges. The discharge nozzles 6, 7 are preferably inclined relative to the longitudinal axis of the receiving containers 1, 2. It is additionally essential for the dispenser bottle according to the second form of embodiment (FIG. 2) that the discharge nozzles 6, 7 extend parallel in the direction of the longitudinal axis of the receiving containers 1, 2, since with this dispenser bottle there is preferably applied by gravitational force washing agent to the flushing-in chamber of the washing machine or an additive for the drum of a washing machine or a cleaning agent directly to the surface to be cleaned. The receiving containers 1, 2 can be constructed as compressible containers. The discharge nozzles 6, 7 can be seen initially in FIGS. 6*a* and 6*b*, otherwise then also in FIG. 8, and are schematically illustrated in FIGS. 11*a* and 11*b*.

Through the claimed form of the dispenser bottle the pressure for pressing the active fluids out of the receiving containers 1, 2 by the hand of a user or by gravity is applied after pivotation through more than 90°. The active fluids leave the discharge nozzles 6, 7, to which they flow from the outlets 3, 4 of the two receiving containers 1, 2, under pressure. Only after departure from the discharge nozzles 6, 7 does there take place, depending on the pressure exerted by the user, collision of the flows of the active fluids at a specific spacing and mixing thereof to form the product to be employed at the region of application.

The illustrated and preferred example of embodiment according to FIGS. 1*a*, 2*a* now also shows that the receiving containers 1, 2 consist of a material with a restoring characteristic and/or have a shape promoting restoration to the original form. It is particularly recommended to make the receiving containers 1, 2 from a resilient restoring plastics material. Such a material for the receiving containers 1, 2 can be, for example, a polyolefin, particularly a polypropylene (PP), a polyethylene (PE), a polyvinylchloride (PVC) or a polyethylene-terephthalate (PET), particularly a glycol-modified polyethylene-terephthalate (PETG). To that extent reference may again be made to the plastics material spray bottle of EP 0 911 616 B1 already explained in the introduction. Materials of that kind are also suitable for the present case of use.

It is of interest in the case of the previously explained form of the receiving containers 1, 2 that due to the special geometry of the receiving containers 1, 2 in conjunction with the material used an optimum compressibility can be connected with an even return suction effect for the active fluids. An even, effective return suction effect for the active fluids from the discharge nozzles 6, 7 back into the receiving containers 1, 2 is of significance for cleaner product cut-off at the outer ends of the discharge nozzles 6, 7 at the conclusion of dosing of the active fluid.

All in all, use of plastics material containers with an appropriate restoring characteristic is economic and, notwithstanding, allows effective dosing of the active fluids in the desired manner, as explained further above, without prior mixing.

The embodiments of a dispenser bottle according to the invention illustrated in the drawings show for the receiving containers 1, 2 in concrete terms the same volume and the same shape in mirror image. In principle, it would also be possible to provide different volumes if through the shape, wall strength and material selection of the receiving containers 1, 2 the desired dosing of the active fluids, which would then be different, from the receiving containers 1, 2 is achieved. Typical volumes of receiving containers 1, 2 in the domestic field of use lie between 50 milliliters and 1,500 millimeters, wherein a preferred range lies between 300 milliliters and 500 milliliters for each of the receiving containers 1, 2. That is obviously specific to use and dependent on the active fluids.

Figure 6A:
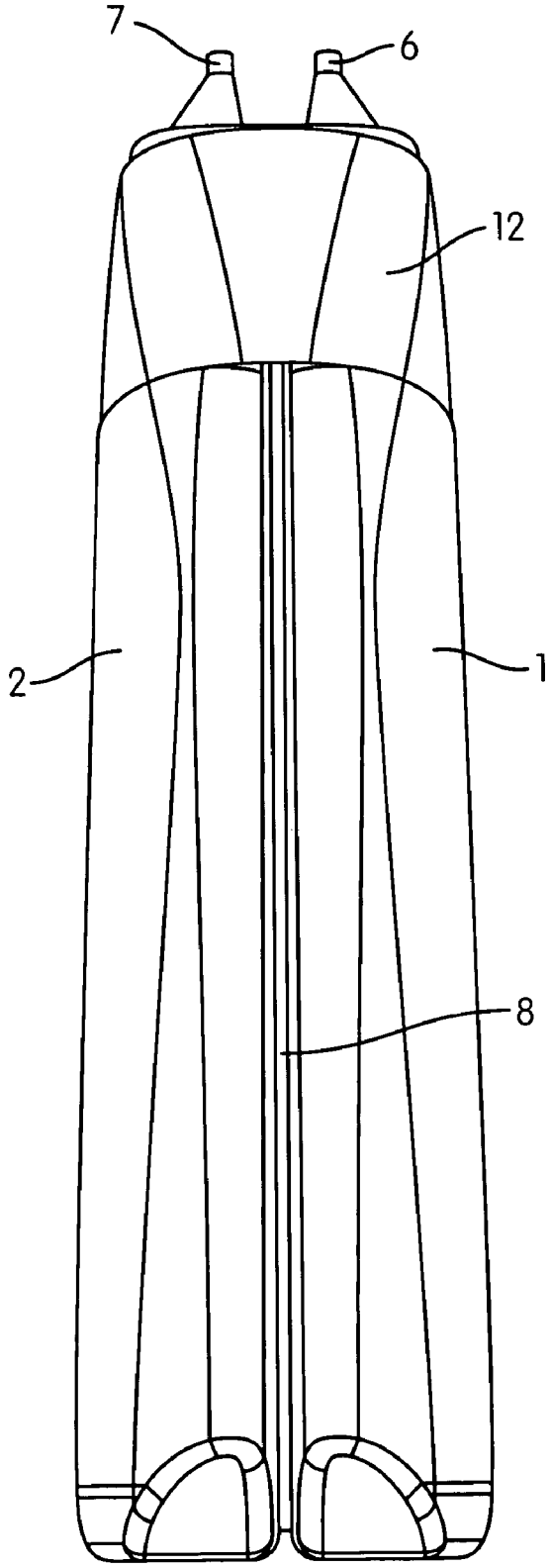
FIG. 6*a* shows the dispenser bottle in a view of the rear side, as in FIG. 5*a* without closure cap.
Figure 6B:
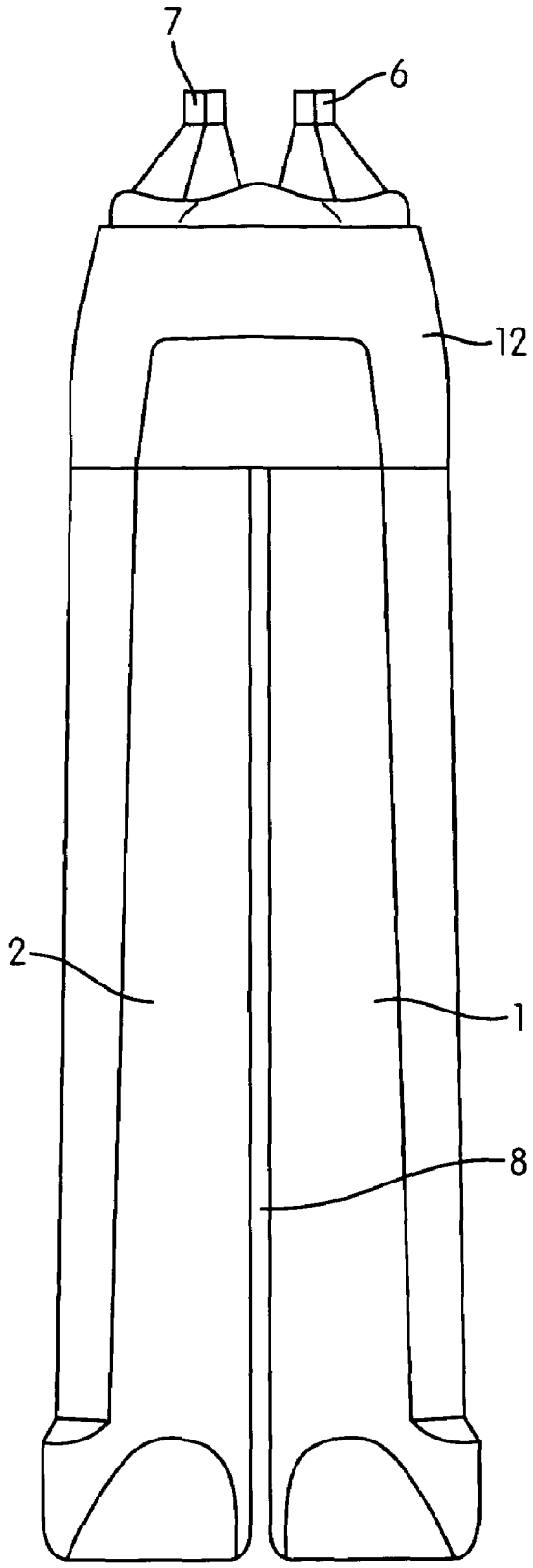
FIG. 6*b* shows the dispenser bottle in a view of the rear side, as in FIG. 5*b* without closure cap.
Figure 7:
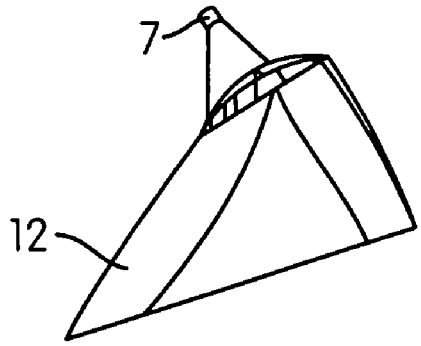
FIG. 7 shows the dosing head of the dispenser bottle of FIG. 6 in a side view.

The illustrated and preferred examples of embodiment according to FIGS. 1*a* and 1*b* allow recognition particularly in FIG. 4, but also in FIGS. 6*a* and 6*b*, that the receiving containers 1, 2 are each formed as a respective complete container and are connected together only by way of at least one, preferably exactly one, connecting web 8 constructed between the receiving containers 1, 2. The connecting web 8 is preferably formed integrally at the mutually facing inner sides of the receiving containers 1, 2, particularly, for example, formed simultaneously with the receiving containers 1, 2 by a blow-moulding method. It is particularly advantageous if the connecting web 8 is arranged approximately centrally and extends—optionally with interruptions—over substantially the full length of the receiving containers 1, 2. The connecting web 8 thus forms a reinforcing element for the mutually facing walls of the receiving containers 1, 2, stabilises these and at the same time leads to formation of a buttress for the pressure forces exerted by the hand of the user. In general, the receiving containers 1, 2 should together have a cross-section of such a form that it can in all cases be grasped for the greatest part by the hand of a user.

In the foregoing there has already been discussion of the blow-moulding method as an advantageous method of production of the receiving containers 1, 2. With appropriate modification, particularly of the blow-moulding method, it is possible for the receiving containers 1, 2 constructed integrally with one another to have a different transparency and/or different coloration. It can be especially recommended notwithstanding the integral construction to form one receiving container to be opaque and the other receiving container to be transparent or, in the case of several receiving containers, to form the receiving containers with different coloration. It has proved that many active fluids are sensitive to light. Other active fluids to be applied in conjunction with the respective active fluid are less sensitive to light. An opaque coloration of the receiving container for the active fluid more sensitive to light eliminates problems in this respect.

With regard to handling by a user the dispenser bottle according to FIGS. 1*a*, 2*a* illustrated in the drawing is further distinguished by the fact that a holding region 9 to be grasped by the hand of the user is formed and/or characterised at the receiving containers 1, 2 by special edge shapings 10, 11 and/or surface designs. This can be recognised particularly readily in FIGS. 1 and 2. The recessed grip provides positive encouragement to grasp the dispenser bottle from that point by hand. The dispenser bottle has a specific position with respect to the hand of the user, which is predetermined by the edge shapings 10, 11. Coming into question as surface designs are, for example, also ribbings, other colorations, etc.

With respect to dimensions it has proved advantageous not to allow the receiving containers 1, 2 to be too large, so as to not hinder ease of handling. Preferred dimensions result if the receiving containers 1, 2 in cross-section have, in the holding region 9 to be gripped by the hand of a user, an outer circumference of approximately 18 to approximately 30 centimeters, preferably from approximately 20 to approximately 28 centimeters, especially from approximately 22 to approximately 26 centimeters, more especially of approximately 24 centimeters.

It has already been explained further above what can be achieved by the dispenser bottle with the receiving containers 1, 2 designed in accordance with the invention. With reference particularly to FIGS. 6*a* and 6*b*, FIG. 8, FIGS. 11*a* and 11*b* and FIG. 12 it can to that extent be explained that the form and dimensions of the discharge nozzles 6, 7 and the characteristics of the active fluids are so matched to one another that—in the case of average pressure by the hand of a user or by pressure produced through gravitational force—the fluid flows come into coincidence at a specific distance. This means, in particular, that in the case of the illustrated example of embodiment of a dispenser bottle the fluid flows come into coincidence at a distance of approximately 50 millimeters to approximately 300 millimeters, preferably from approximately 100 millimeters to approximately 250 millimeters, especially of approximately 150 millimeters. That is then thus approximately the spacing between the discharge nozzles 6, 7 and the application field. That corresponds with the dimensions of usual spacings as followed in the household for cleaning measures.

With respect to the viscosity of the active fluids it is recommended to use active fluids with viscosities in the region of 1 to 100,000 mPas, preferably up to approximately 10,000 mPas, particularly up to approximately 1,000 mPas. The basis of these figures is measurement of the viscosity by a Brookfield viscosimeter LCT-II at 20 rpm and 20° C., spindle 3.

Aqueous solutions of the kind already discussed in the general part of the description may frequently be used (see, to that extent, also U.S. Pat. No. 5,911,909 A and U.S. Pat. No. 5,972,239 A, the disclosure content of which is equally incorporated, by reference, into the disclosure content of the present patent application). Reference has already been made in the foregoing that it can be of particular significance for the teaching of the present invention if at least one of the active fluids is a thixotropic active fluid. Especially, however, all active fluids used should be thixotropic, preferably with approximately the same thixotropy. To that extent reference may be made, for explanation of the complex relationships of thixotropic active fluids, to the above-indicated passage from RÖMPP.

FIGS. 3 and 4 show the receiving containers 1, 2 with the outlets 3, 4. In this case the outlets 3, 4 are oriented to be parallel to one another. A preliminary orientation of the flows of the active fluids can also be created in that the outlets 3, 4 of the receiving containers 1, 2 are already oriented to be somewhat inclined towards one another. However, the illustrated parallel orientation has advantages in terms of production engineering.

In principle, it is possible, but not with the blow-moulding method realised here in practice, to form the discharge nozzles 6; 7 integrally with the receiving container 1; 2 at the outlet 3; 4. This variant has not, however, been selected in the illustrated example of embodiment. Rather, in the illustrated example of embodiment it is provided that the discharge nozzle 6; 7 is arranged or formed in a separate nozzle head 12 here consisting of a plastics material of stable shape and that the nozzle head 12 is placed on the receiving container 1; 2 at the outlet 3; 4. The nozzle head 12 is identified in the figures in each instance by reference numeral 12. Applicable to the illustrated example of embodiment is that the nozzle head 12 is detented to the receiving container 1; 2. The nozzle head 12 can also be connected with the receiving container 1; 2 in another manner. However, indenting is recommended as a particularly simple and advantageous production technique.

For detenting the nozzle head 12 to the respective receiving container 1; 2 it is recommended to provide, at the outlet 3; 4 of the receiving container 1; 2, corresponding detent connecting means for complementary detent connecting means of the nozzle head 12. Detent connecting means of that kind are known in appropriate constructions from the state of the art. In principle, other connecting techniques such as, for example, screw connections can also be employed.

The illustrated and preferred examples of embodiment are distinguished particularly by the fact that the nozzle heads 12 of the two receiving containers 1; 2 are combined to form a common nozzle head 12. This common nozzle head 12 can be seen in FIGS. 7, 8, 9 and 10 as well as 12 and 14. It is very practical in terms of production engineering and that best adapted to the connecting of the two receiving containers 1, 2.

It is recommended to produce a nozzle head 12 from a stiffer plastics material, so that the nozzle head 12 experiences only slight deformation when the receiving containers 1, 2 of the dispenser bottle are compressed.

Figure 5A:
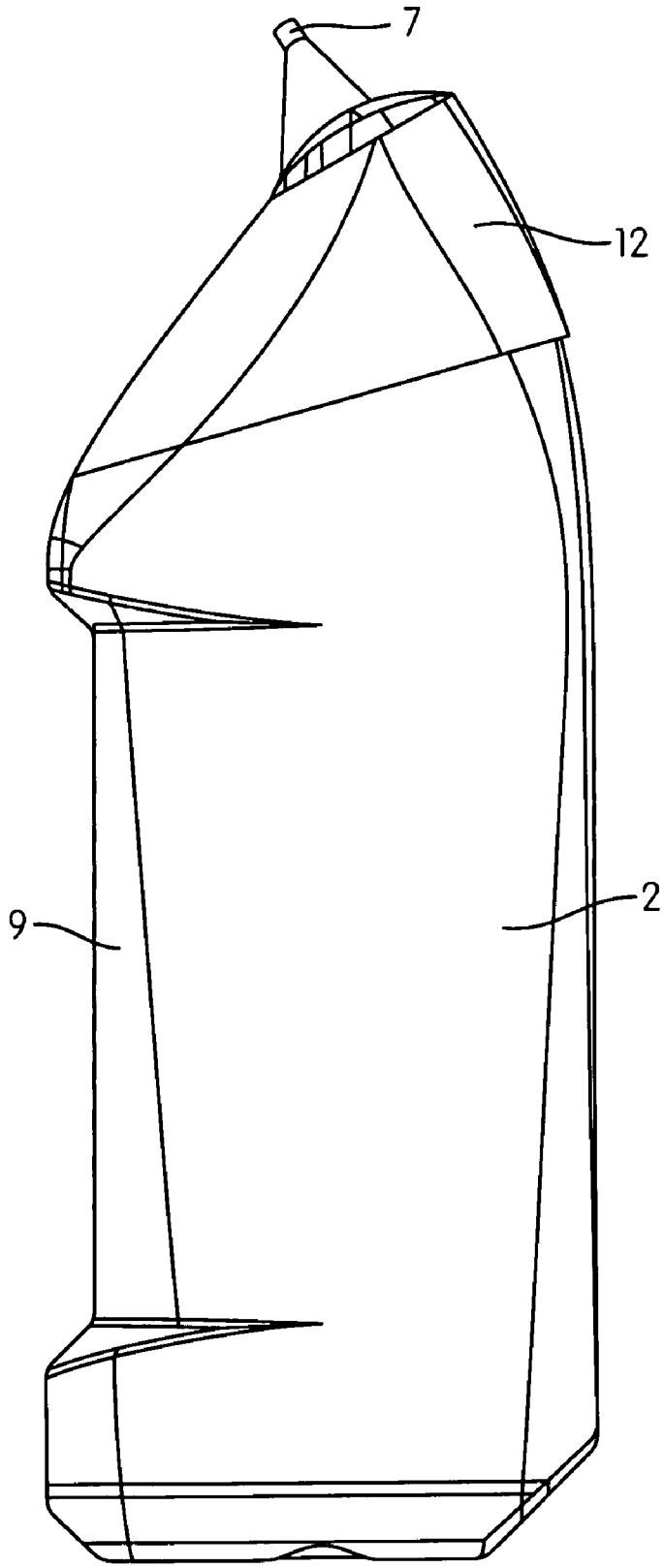
FIG. 5*a* shows the dispenser bottle in a side view according to FIG. 2*a*, the closure cap for the discharge nozzles being removed.
Figure 5B:
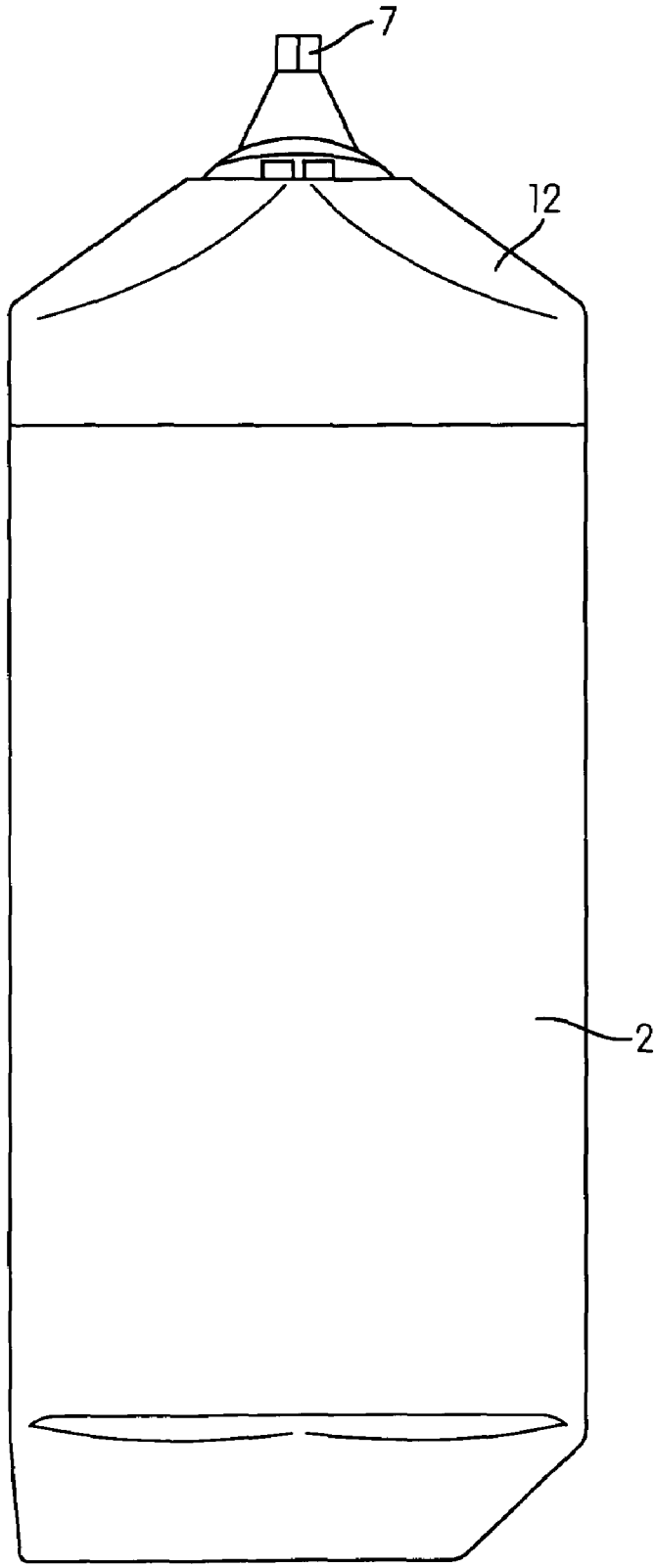
FIG. 5*b* shows the dispenser bottle in a side view according to FIG. 2*b*, the closure cap for the discharge nozzles being removed.

There are now a number of design possibilities for the nozzle head 12, which shall be explained in the following. The nozzle head 12 can be recognised in the above-indicated illustrations as well as in FIG. 5 and FIG. 6. The nozzle head 12 can be seen particularly well in section in FIGS. 8, 9 and 10. It has proved to be advantageous for the flow of the active fluid in the nozzle head 12 if the discharge nozzle 6; 7 is arranged in the nozzle head 12 to be asymmetrical, especially offset relative to the centreline of the outlet 3; 4 in the direction of the further outlet nozzles 7; 6. This can be seen particularly clearly in FIG. 8. The flow of the active fluid from the respective receiving container 1; 2 is led up at the desired distance to the active fluid flowing out in parallel.

In that case there can be seen here a constructional solution which ensures a laminar flow. In particular, it is provided for the nozzle head 12 to have an incident flow volume 13 which reduces from the outlet 3; 4 of the receiving container 1; 2 to the discharge nozzle 6; 7. This incident flow volume 13 can be understood particularly readily in FIG. 8 and FIG. 9.

The illustrated and preferred example of embodiment shows dimensioning of such a kind that the lateral centre spacing of the discharge nozzles 6; 7 is at the outside approximately 5 millimeters to approximately 30 millimeters, preferably approximately 15 millimeters to approximately 20 millimeters.

Figure 10:
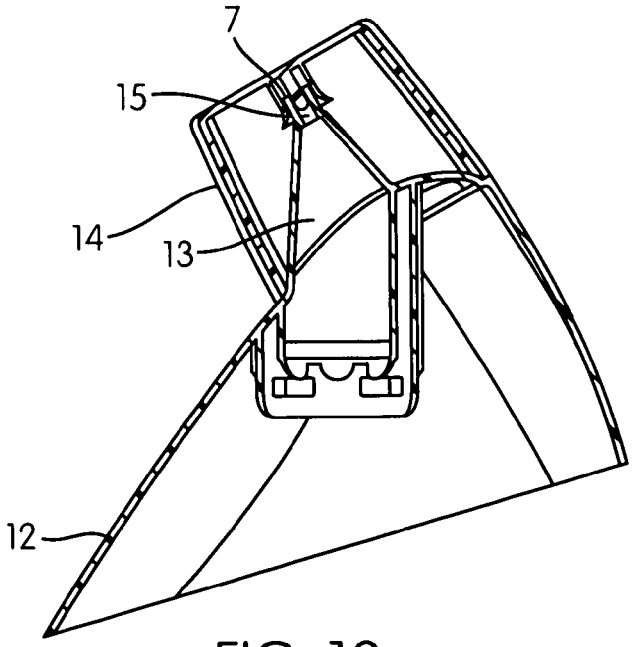
FIG. 10 shows, in an illustration corresponding with FIG. 9, the dosing head, now with closure cap fitted.
Figure 14:
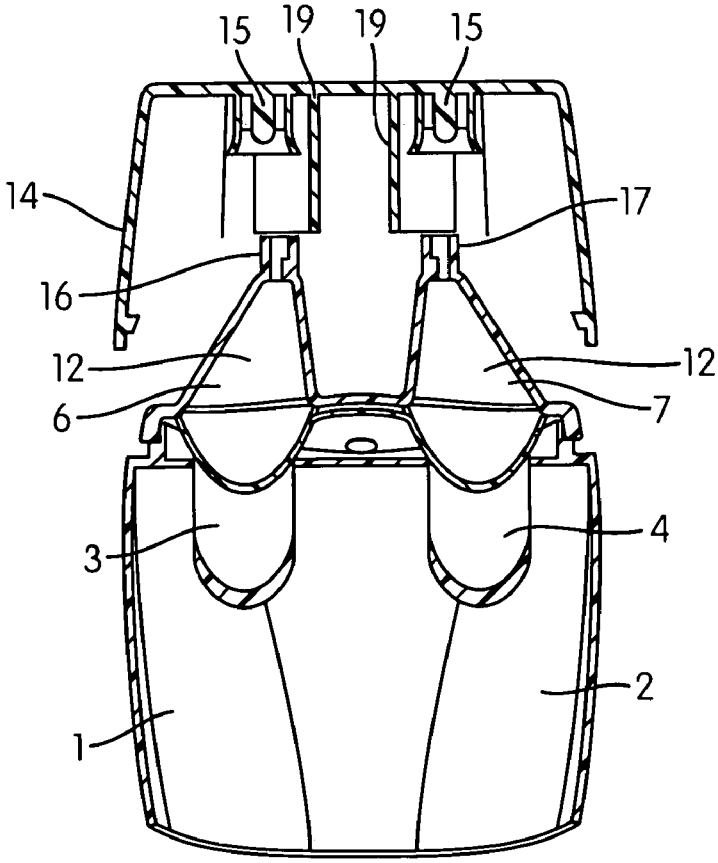

It can be recognised from FIGS. 1*a*, 1*b* and 2*a*, 2*b*, as well as FIG. 10, that for the dispenser bottles illustrated here the outlet nozzle 6; 7 is closable by a removable closure cap 14, which preferably consists of a plastics material stable in shape. In that case it is provided that the closure cap 14 has a closure plug 15 entering into the discharge nozzle 6; 7. This technique is already proven for avoidance of cross-contaminations (cf. above WO 91/04923 A1). In another form of embodiment, as illustrated in FIGS. 14 and 15, the closure cap 14 has as positioning aid a respective cylinder section 19, which is curved convexly relative to the longitudinal axis of the closure cap 14, laterally adjacent to the closure plug 15 entering into the discharge nozzle 6; 7. This cylinder section 19 is spaced from the closure plug 15 in such a manner that the free ends of the cylinder section 19 in closed setting abut against the discharge nozzles 6, 7. When the closure cap 14 is placed on the dispenser bottle the lower ends of the cylinder sections 19 slip along the inclined surfaces of the discharge nozzles 6, 7, the movement thus being positively guided. The process of placing the closure cap 14 together with the cylinder sections 19 as positioning aids and the closure plugs 15 on the discharge nozzles 6, 7 is schematically illustrated in FIG. 14.

The illustrated and preferred examples of embodiment show, as recognisable particularly clearly in FIGS. 1*a*, 1*b*, as well as 14, that it is also appropriate for the closure cap 14 to be combined into one for both discharge nozzles 6, 7 of the two receiving containers 1, 2. That is advantageous in terms of production engineering in the same way as explained to be advantageous for the nozzle head 12. Expediently, the closure cap 14 consists of a plastics material similar to or the same as that of the nozzle head 12.

It can be inferred from the drawings that the discharge nozzles 6, 7—obviously—have a nozzle channel 16 or 17. In that case it could be provided to incline the nozzle channels 16, 17 of the discharge nozzles 6, 7 towards one another. The issuing flows of the active fluids would then already have an orientation towards a common application field.

The illustrated and, to that extent, preferred example of embodiment shows, however, that the nozzle channels 16, 17 of the discharge nozzles 6, 7 are oriented parallel to one another. A slight inclination is obviously acceptable within the scope of, for example, production tolerances.

It is especially advantageous, particularly in the case of the last explained example of embodiment illustrated in the drawing and with the nozzle channels 16, 17 oriented substantially parallel to one another, if the nozzle channels 16; 17 of the discharge nozzles 6; 7 each have a cross-sectional constriction 18 arranged asymmetrically with respect to the overall flow cross-section.

In the general part of the description reference has already been made to the special significance of the cross-sectional constriction 18 in the respective nozzle channels 16 or 17. This can be understood on the basis of FIGS. 11*a* and 11*b*.

The cross-sectional constriction 18 in the respective nozzle channel 16, 17 has the consequence that a certain degree of twist is imparted to the flows of the active fluids so that in the exit region of the discharge nozzles 6, 7 there takes place in each instance a certain degree of deflection so that the flows of the active fluids impinge, with intermixture, in the application field at a distance dependent to a certain degree on the pressure of the hand of the user on the receiving containers 1, 2.

There is thus achieved guidance together of the flows of the active fluids not by orientation of the nozzle channels 16, 17, but by influencing of the flow. Moreover, there is achieved a complete coincidence of the flows of the active fluids in the application field 5 and not merely a partial coincidence attained by scatter effect, as could occur with unmodified nozzle channels 16, 17.

The last-explained, particularly preferred form of embodiment of the invention now requires further explanations.

FIGS. 11*a*, 11*b* show at the top the principle of functioning of the cross-sectional constrictions 18 and at the bottom an example of the arrangement of the cross-sectional constrictions 18 in the mutually adjacent nozzle channels 16, 17. Here there can be initially seen that in the illustrated and, to that extent, preferred example of embodiment the cross-sectional constrictions 18 of the nozzle channels 16, 17 are executed with edged transitions. This has the consequence in terms of flow that different flow speeds arise over the flow cross-section of the nozzle channel 16; 17. At a distance from the cross-sectional constriction 18 the active fluid can flow comparatively undisturbed, a high flow speed with lamina flow being retained. At the cross-sectional constriction 18, thereagainst, a substantially increased flow speed does indeed arise in the narrowest cross-section, but on departure from the narrow point there is again a strong decrease in flow speed in conjunction with creation of turbulence. This leads overall to the twist-like behaviour of the flows of the active fluids as discussed above.

In addition, it can be recognised in FIGS. 11*a*, 11*b* that the cross-sectional constrictions 18 are arranged at the mutually facing sides of the nozzle channels 16; 17 in such a manner that the flows, which issue under pressure, of the active fluids have such a twist that they run into one another.

Figure 12:
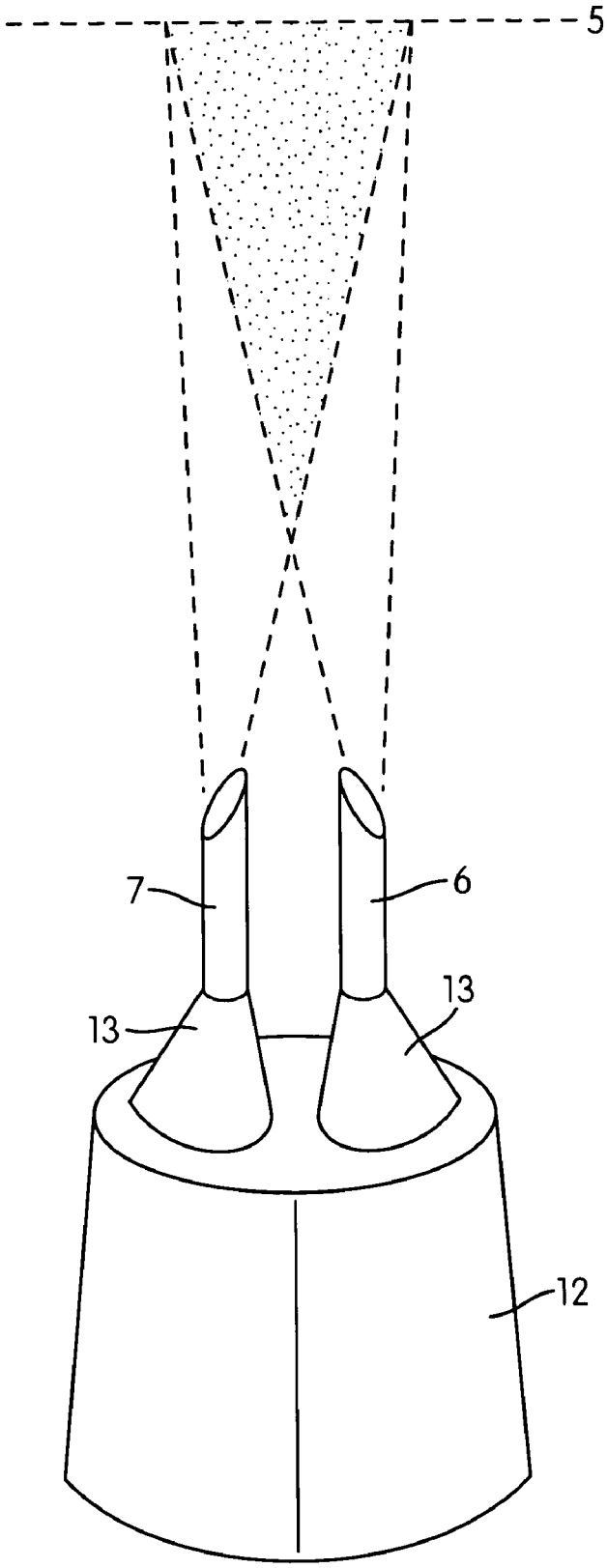
FIG. 12 shows the jet pattern of the active fluids in a further example of embodiment of a dispenser bottle according to the invention, with outlet nozzles with obliquely ending dosing channels.

By contrast to the example of embodiment of FIG. 11*a* the example of embodiment according to FIG. 11*b* has an inclined plane of opening of the nozzle channels 16, 17, cf. also nozzle head 12 according to FIG. 12. Through the chamfering of the ends of the nozzle channels the twist effect is similarly produced by virtue of different flow speeds at the outlet. The twist effect is produced in that the openings of the nozzle channels of the discharge nozzles are chamfered relative to one another. The planes of opening of the nozzle channels 6, 7 are arranged at an angle relative to one another, wherein the section of the wall of the discharge nozzle disposed at the inside relative to the longitudinal axis of the nozzle channel is longer than the section of the wall lying at the outside relative to the longitudinal axis of the nozzle channel. In the case of an example of embodiment, which is not illustrated, there are provided for producing the twist effect only inclined openings at the end of the nozzle channel, but not a cross-sectional constriction in the nozzle channel.

Figure 12A:
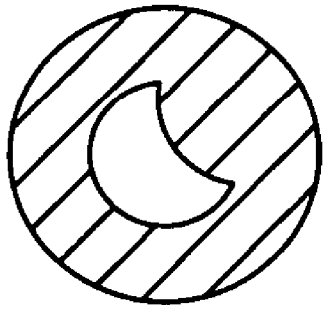
FIG. 12*a* shows the dosing channel in section at the level of the cross-sectional constriction in the case of a further example of embodiment, FIG. 12*b* correspondingly shows the dosing channel in a third example of embodiment.
Figure 12B:
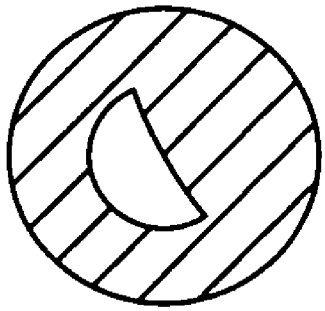
Figure 13:
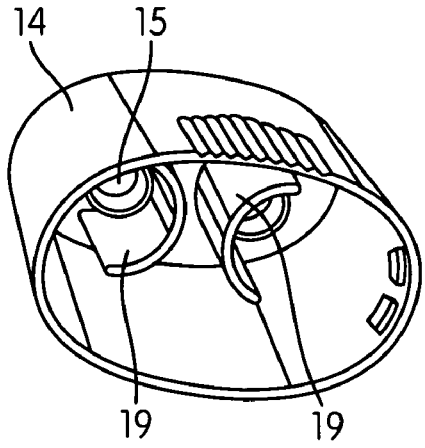
FIG. 13 shows a closure cap with positioning aid and FIG. 14 shows a dispenser bottle with a closure cap according to FIG. 13.

In the illustrated example of embodiment according to FIGS. 11*a*, 11*b* the respective cross-sectional constriction 18 is executed as an inwardly arched curve. FIGS. 12*a* and 12*b* show further advantageous cross-sectional designs. Here there is possibly also selected, with the different active fluids, different cross-sectional shapes for the cross-sectional constrictions 18 just as for the nozzle channels 16, 17.

It has proved advantageous for the action of the cross-sectional constriction 18 if this is not present over the full length of the nozzle channel 16; 17, but is confined to a short portion of this length. It is thus recommended that the length of the cross-sectional constriction 18 of the nozzle channel 16; 17 is in total only a part of the length of the nozzle channel 16; 17. It is particularly recommended for the length ratio to be approximately 1:2 to 1:4, preferably approximately 1:2.5 to 1:3.

For the domestic field of use particularly in mind and the use of low-viscosity, preferably thixotropic active fluids it is recommended that the total length of the nozzle channel 16; 17 is approximately 2 millimeters to approximately 6 millimeters, preferably approximately 3 millimeters to approximately 5 millimeters, especially approximately 4 millimeters. Correspondingly, the diameter of the nozzle channel 16; 17 is approximately 1.0 millimeters to approximately 4.0 millimeters, preferably approximately 1.5 millimeters to approximately 3.5 millimeters, especially approximately 2.0 millimeters to approximately 2.5 millimeters.

Now that the constructional form of the dispenser bottle according to the invention has been substantially completely described, it is necessary to discuss which forms of active fluids can be applied in particularly advantageous manner by such a dispenser bottle. For this purpose there are a number of advantageous combinations and recipes, which will be discussed in the following.

The forms of active fluids which are applied by the dispenser bottle according to the invention are directed in the first instance towards to field of use. Thus, for example, for the purposes of disinfecting (for example, for cleaning lavatories) different combinations of active fluids are used than in the field of washing agents, dishwashing agents and anti-corrosion agents.

According to the invention particularly preferred combinations of active fluids, as used for different fields of use, are described. These different combinations of active fluids are, however, to be understood as only by way of example and in no respect restrict the field of use of the dispenser bottle according to the invention to the combinations stated there.

Moreover, it is possible to use, as different active fluids for the different receiving containers 1, 2, such active fluids as are known for two-phase or multi-phase cleaning agents, wherein, however, in departure from the two-phase or multi-phase cleaning agents known per se the different phases of these cleaning agents are in ready-for-use state in the different receiving containers 12.

With respect to two-phase and multi-phase cleaning agents, reference can be made to the following specifications, the disclosure of which is hereby included by reference: DE 198 11 387 A or WO 99/47634 A, DE 198 11 386 A or WO 99/47635 A, DE 198 59 774 A or WO 00/39270 A, DE 100 62 045 A or WO 02/48308 A, DE 100 60 096 A or WO 02/44314 A, DE 198 59 799 A or WO 00/39268 A, DE 198 59 808 A or WO 00/39267 A, DE 198 59 778 A or WO 00/39269 A, DE 199 36 727 A or WO 01/10996 A, DE 199 45 506 A or WO 01/21753 A, DE 199 45 503 A or WO 01/21755 A, DE 199 45 505 A or WO 01/21754 A and DE 101 37 047 A. For the application of, in particular, washing agents, the dispenser bottle can comprise, for example, recipes in the receiving containers 1, 2 such as described in DE 102 15 602 A1 and DE 101 49 719 A1, the entire content of which is hereby included by reference.

Various uses of a dispenser bottle, also form the subject of the teaching of the present invention. Special examples of use, on the basis of which the invention can be further understood in individual applications, here follow. These do not restrict the teaching of the present invention.

EXAMPLES OF EMBODIMENT

Example 1

Example 1 indicates different recipes of active fluids which can be used in a dispenser bottle according to the invention for lavatory cleaning.

Liquid lavatory cleaners are sufficiently known on the market. Products of that kind usually contain anorganic or organic acids for elimination of calcium and rust deposits, as well as surfactants for cleaning enhancement, abrasives, viscosity regulators, antibacterial additives, dye and perfume for odour elimination. Beyond that, alkaline lavatory cleaners are known which are formulated on the basis of sodium hypochlorite, surfactants and above-mentioned additive components. These products have a good bleaching and disinfecting action, but are not in a position of removing contaminants containing calcium. Moreover, acid-free formulations are on the market which do not in fact have any calcium removal or bleaching action, but through the surfactant content assist the cleaning result in the case of organic contaminations and due to the absence of acidic and bleaching components are easier to perfume. These cleaners, however, are less effective in the elimination of tenacious contaminations.

It is common to all traditionally known lavatory cleaners that they are sold in mono-tank plastics material bottles with special dosing attachments. The formulation of a lavatory cleaner in a mono-tank bottle presupposes, however, that the active ingredients employed are compatible with one another and also have a sufficient storage stability over a longer period of time. This leads to limitations in the formulation of effective cleaners, since the usually employed active ingredients of acid, bleach, perfume oil and abrasives can enter into undesired reactions at least in the case of a longer period of contact.

The dispenser bottle according to the invention enables expansion of the spectrum of capability of lavatory cleaners by the use also of incompatible or reactive active ingredients. Thus, for example, acidic cleaning agents containing peroxide are extremely effective not only in their bleaching and disinfecting action, but also in the removal of calcium deposits, yet in conventional bottles have only a low storage stability. Through accommodation of the peroxide solution in one chamber and the acid in the second chamber of the dispenser bottle according to the invention a cleaning agent is obtained which is stable over a considerably longer period of time. A further example is the combination of an alkaline bleaching agent, which contains hypochlorite, in one chamber with an acidic and thus calcium-dissolving agent in the second chamber. In addition, the combination of an acidic agent with an alkaline phase containing carbon can be realised only in a dispenser bottle according to the invention. On mixing of these two phases (when the agent is used), carbon dioxide is liberated which leads to foaming of the agent and assists the cleaning performance.

The described agents with a decalcification phase all exhibit a good calcium dissolution activity with values according to the IKW standard test of 150 to 350 milligrams of calcium carbonate for the 1:1 mixture of the two phases.

The following examples of formulation are in no sense to be understood as a conclusive list. Rather, all active ingredients known to the expert can be used as constituents of cleaning agents in dispenser bottles according to the invention in the manner that feasible combinations are formulated within one phase. In particular, the indicated details of quantities are also not binding, but the stated, and other, ingredients can be used within wider limits.

Formulation Examples

Formulation 1

Receiving container A: Product with perfume-free decalcifying phase with high acid content Receiving container B: High-quality aromatic phase

| Receiving container A: Decalcifying phase | |
|---|---|
| acid, e.g. sulphamic acid | 5.00 to 12.00 wt. % |
| stabiliser, e.g. urea | 2.00 to 6.50 wt. % |
| non-ionic surfactant, e.g. fatty alcohol ethoxylate $C_{13}$ 8EO | 0.50 to 5.00 wt. % |
| dye, e.g. Hostafine Blue B 2 G C.I. 74160 | <0.01 wt. % |
| acid-stable thickener, e.g. xanthane (polysaccaride) | 0.01 to 2.00 wt. % |
| tap water | ad 100 wt. % |
| Technical Data: | |
| Viscosity: | 500 to 1,000 mPas, 20° C. Rotovisko LVT, spindle 31, at 20 n/min |
| pH value (concentrated) | 0.5 to 2.5 |
| Receiving container B: Aromatic phase | |
| non-ionic surfactant, e.g. alkyl ($C_8$-$C_{10}$)-1.5-glucoside | 0.50 to 5.00 wt. % |
| ethanol | 0.50 to 5.00 wt. % |
| thickener, e.g.: xanthane (polysaccharide) | 0.01 to 2.00 wt. % |
| perfume, e.g. Luminous Lemon (manuf. Dragoco) | 0.10 to 1.00 wt. % |
| dye, e.g. Lumogen Yellow (BASF; C.I. Pigment Yellow 101) | <0.03 wt. % |
| tap water | ad 100 wt. % |
| Technical Data: | |
| Viscosity: | 500 to 1,000 mPas, 20° C. Rotovisko LVT, spindle 31, at 20 n/min |
| pH value (concentrated) | 7.0 to 10.00 |

This formulation cannot be realised in a single chamber bottle, since high-quality perfumes are not sufficiently stable in storage due to the influence of acid. However, this formulation is desirable, since apart from an optimum calcium removal a long-lasting aroma is desired.

Formulation 2:

Receiving container A: Product with perfume-free decalcifying phase with high acid content Receiving container B: High-quality perfumed, stabilised abrasive phase

| Receiving container A: Decalcifying phase | |
|---|---|
| acid, e.g. sulphamic acid | 5.00 to 12.00 wt. % |
| stabiliser, e.g. urea | 2.00 to 6.50 wt. % |
| non-ionic surfactant, e.g. fatty alcohol ethoxylate $C_{13}$ 8EO | 0.10 to 5.00 wt. % |

-continued

| | |
|---|---|
| dye, e.g. Hostafine Blue B 2 G C.I. 74160 | <0.01 wt. % |
| acid-stable thickener, e.g. xanthane (polysaccaride) | 0.01 to 2.00 wt. % |
| tap water | ad 100 wt. % |
| Technical Data: | |
| Viscosity: | 500 to 1,000 mPas, 20° C. Rotovisko LVT, spindle 31, at 20 n/min |
| pH value (concentrated) | 0.5 to 2.5 |
| Receiving container B: Aromatic phase with abrasive | |
| non-ionic surfactant, e.g. alkyl ($C_8$-$C_{10}$)-1.5-glucoside | 0.50 to 5.00 wt. % |
| ethanol | 0.50 to 5.00 wt. % |
| polysaccharide, e.g.: xanthane | 0.01 to 2.00 wt. % |
| perfume, e.g. Outdoors (manuf. Dragoco) | 0.10 to 1.00 wt. % |
| dye, e.g. Lumogen Yellow (BASF; C.I. Pigment Yellow 101) | <0.03 wt. % |
| abrasive, e.g.: aluminium oxide <0.1 μm | 0.50 to 2.0 wt. % |
| preservative, e.g. hemiacetal-isothiazolin-combination | <0.50% |
| tap water | ad 100 wt. % |
| Technical Data: | |
| Viscosity: | 500 to 1,000 mPas, 20° C. Rotovisko LVT, spindle 31, at 20 n/min |
| pH value (concentrated) | 7.0 to 10.00 |

The stability of high-quality aromatics and abrasives can be realised to optimum extent in the alkaline medium. The combination of strongly acidic decalcifier with an aromatic and abrasive phase has the consequence, in the case of mechanical use with a toilet brush, of enhanced results and shine on the toilet ceramic.

Formulation 3

Receiving container A: Powerful decalcifier on the basis of organic acids

Receiving container B: Abrasive formula, adjusted to reduced acidity, with aromatic phase

| | |
|---|---|
| Receiving container A: Decalcifying phase with organic acids | |
| acid, e.g. formic acid, citric acid mixture | 5.00 to 12.00 wt. % |
| non-ionic surfactant, e.g., alkyl ($C_8$-$C_{10}$)-1.5-glucoside | 0.10 to 6.00 wt. % |
| dye, e.g. Hostafine Blue B 2 G C.I. 74160 | <0.01 wt. % |
| polysaccaride, e.g. xanthane | 0.01 to 2.00 wt. % |
| tap water | ad 100 wt. % |
| Technical Data: | |
| Viscosity: | 500 to 1,000 mPas, 20° C. Rotovisko LVT, spindle 31, at 20 n/min |
| pH value (concentrated) | 0.5 to 2.5 |
| Receiving container B: Abrasive formula, adjusted to reduced acidity, with aromatic phase | |
| non-ionic surfactant, e.g. alkyl ($C_8$-$C_{10}$)-1.5-glucoside | 0.50 to 5.00 wt. % |
| ethanol | 0.50 to 5.00 wt. % |
| acid, e.g. formic acid, citric acid mixture | 1.5 to 6 wt. % |
| polysaccharide, e.g.: xanthane | 0.01 to 2.00 wt. % |
| perfume, e.g. Lake Side (manuf. Firmenich) | 0.10 to 1.00 wt. % |
| dye, e.g. Lumogen Yellow (BASF; C.I. Pigment Yellow 101) | <0.03 wt. % |
| abrasive, e.g.: aluminium oxide <0.1 μm | 0.50 to 2.0 wt. % |

-continued

| | |
|---|---|
| preservative, e.g. hemiacetal-isothiazolin-combination | <0.10% |
| tap water | ad 100 wt. % |
| Technical Data: | |
| Viscosity: | 500 to 1,000 mPas, 20° C. Rotovisko LVT, spindle 31, at 20 n/min |
| pH value (concentrated) | 1.0 to 4.0 |

The perfume is selected so that, in the aromatic/abrasive phase adjusted to be reduced a sufficient stability is ensured. A maximum cleaning efficacy is achieved through the reinforcement by the decalcifying phase (adjusted to be strongly acidic).

Formulation 4

Receiving container A: Product with perfume-free decalcifying phase with high acid content Receiving container B: High-quality perfumed reactive-foaming abrasive phase

| | |
|---|---|
| Receiving container A: Decalcifying phase | |
| acid, e.g. sulphamic acid | 5.00 to 12.00wt. % |
| stabiliser, e.g. urea | 2.00 to 6.50 wt. % |
| non-ionic surfactant, e.g. fatty alcohol ethoxylate $C_{13}$ 8EO | 0.10 to 6.00 wt. % |
| dye, e.g. Hostafine Blue B 2 G C.I. 74160 | <0.01 wt. % |
| acid-stable thickener, e.g. xanthane (polysaccaride) | 0.01 to 2.00 wt. % |
| tap water | ad 100 wt. % |
| Technical Data: | |
| Viscosity: | 500 to 1,000 mPas, 20° C. Rotovisko LVT, spindle 31, at 20 n/min |
| pH value (concentrated) | 0.5 to 2.5 |
| Receiving container B: High-quality perfumed, reactive-foaming abrasive phase | |
| anionic surfactant, e.g. secondary $C_{14-17}$ alkanesulfonate-Na | 0.50 to 5.00 wt. % |
| reactive abrasive, e.g. calcium carbonate, fine, powder | 0.10 to 2.00 wt. % |
| non-reactive abrasive, e.g. aluminium oxide <0.1 μm | 1.00 to 3.00 wt. % |
| polysaccharide, e.g.: xanthane | 0.01 to 2.00 wt. % |
| perfume, e.g. Outdoors (manuf. Dragoco) | 0.10 to 1.00 wt. % |
| dye, e.g. Sicovit Chinolin yellow 70E104 (BASF) | <0.03 wt. % |
| tap water | ad 100 wt. % |
| Technical Data: | |
| Viscosity: | 500 to 1,000 mPas, 20° C. Rotovisko LVT, spindle 31, at 20 n/min |
| pH value (concentrated) | 7.0 to 10.0 |

Use of a reactive abrasive component such as calcium carbonate is not possible in a single-chamber bottle, since due to the acid components a decomposing reaction would occur under strong development of gas (carbon dioxide). The use of a reactive abrasive component is, however, desirable in the case of use of a toilet brush, since through the development of gas and foam an optically visible effect on the ceramic surface is signalled to the user. In addition, an improved spreading behaviour is achieved by the reaction and an optimum aromatic distribution is achieved by the development of gas.

Formulation 5

Receiving container A: White alkaline abrasive phase

Receiving container B: Colourless neutral cleaneer with indicator

| Receiving container A: White alkaline abrasive phase | |
|---|---|
| non-ionic surfactant, e.g. fatty alcohol ethoxylate $C_{13-14}$ 6EO, fatty alcohol $C_{12-14}$ 6.4 EO, 1.2 PO, mixture | 0.10 to 6.00 wt. % |
| alkali, e.g. monoethanolamine | 0.10 to 1.00 wt. % |
| abrasive, e.g. calcium carbonate 15 microns | 15 to 40 wt. % |
| perfume, e.g. Lemon (manuf. Dragoco) | 0.10 to 1.0 wt. % |
| thickener, e.g. Rohagit (acrylate) | 0.01 to 2.00 wt. % |
| tap water | ad 100 wt. % |
| Technical Data: | |
| Viscosity: | 750 to 2,000 mPas, 20° C. Rotovisko LVT, spindle 31, at 20 n/min |
| pH value (concentrated) | 8.0 to 11.0 |
| Receiving container B: Colourless neutral cleaner with indicator | |
| thickener, e.g. xanthane (polysaccharide) | 0.01 to 2.00 wt. % |
| ethanol | 5.0 to 15.0 wt. % |
| indicator, e.g. phenolphthalein (1.0%) | 0.50 to 2.00 wt. % |
| deionised water | ad 100 wt. % |
| Technical Data: | |
| Viscosity: | 350 to 800 mPas, 20° C. Rotovisko LVT, spindle 31, at 20 n/min |
| pH value (concentrated) | 7.0 |

In the case of use of the two cleaning liquids neutral in colour a colour reaction arises on the ceramic surface (in the case of use of phenolphthalein as indicator, for example, pink colours), which can only be achieved by way of the dispenser bottle according to the invention. Selection of the suitable indicator dye with specific pH ranges allows use in the region of neutral-alkaline or neutral-weak acidity. As a further indicator dye, by way of example, Bromothymol Blue with a colour change from yellow to blue at the pH change from pH=7 to pH=8 is conceivable. For a colour change of a weak alkaline cleaner with an acidic cleaner there is, for example, Bromophenol Blue with a colour change from yellow to violet at the pH change from pH=2 to pH=6. On the one hand the colour change shall give the user an indication of the pH change and the cleaning effect connected therewith and on the other hand the cleaning can thus be connected with an unexpected effect. This is a variant of interest with respect to marketing.

Formulation 6

Receiving container A: Product with acidic, perfumed decalcifying phase

Receiving container B: Product with alkaline sodium hypochlorite phase with bleaching and disinfecting effect.

| Receiving container A: Product with acidic, perfumed decalcifying phase | |
|---|---|
| acid, e.g. sulphamic acid, citric acid mixture | 7.00 to 18.00 wt. % |

-continued

| | |
|---|---|
| non-ionic surfactant, e.g. fatty alcohol ethoxylate $C_{13}$ 8EO | 0.10 to 5.00 wt. % |
| alkali, e.g. caustic soda | 0.10 to 2.00 wt. % |
| acid-stable thickener, e.g. xanthane (polysaccaride) | 0.01 to 2.00 wt. % |
| dye, e.g. Hostafine Green 6N | <0.01 wt. % |
| acid-stable perfume, e.g. Fontana (manuf. Dragoco) | 0.10 to 1.00 wt. % |
| tap water | ad 100 wt. % |
| Technical Data: | |
| Viscosity: | 500 to 1,000 mPas, 20° C. Rotovisko LVT, spindle 31, at 20 n/min |
| pH value (concentrated) | 0.5 to 3.0 |
| Receiving container B: Product with alkaline sodium hyochlorite phase with bleaching and disinfecting effect. | |
| sodium hypochlorite | 2.00 to 5.00 wt. % |
| anionic surfactant, e.g. sodium alkylsulfate $C_{12-14}$ + 2EO | 1.00 to 5.00 wt. % |
| alkali, e.g. caustic soda | 0.50 to 2.00 wt. % |
| dye, e.g. Hostafine Blue B 2 G C.I. 74160 | <0.01 wt. % |
| thickener, e.g. xanthane (polysaccharide) | 0.01 to 2.00 wt. % |
| tap water | ad 100 wt. % |
| Technical Data: | |
| Viscosity: | 200 to 600 mPas, 20° C. Rotovisko LVT, spindle 31, at 20 n/min |
| pH value (concentrated) | 11 to 14 |

The combination of acid (sulphamic acid) and sodium hypochlorite cannot be realised in a single-chamber bottle due to the immediate reaction of acid with bleaching agent under formation of an unstable reaction product (chlorosulfamate). However, the combination is desirable for the user in order to utilise, apart from the efficacy of the acid, also the bleaching and disinfecting action of the chlorine components. The formation of chlorine gas is prevented by setting the pH value in the reaction mixture to >pH 3.

Formulation 7

Receiving container A: Product with acidic, perfumed decalcifying phase

Receiving container B: Product with stabilised hydrogen peroxide phase with bleaching and disinfecting effect

| Receiving container A: Product with acidic, perfumed decalcifying phase | |
|---|---|
| acids, e.g. citric acid, formic acid mixture | 5.00 to 12.00 wt. % |
| non-ionic surfactant, e.g. fatty alcohol ethoxylate $C_{13}$ 8EO | 0.10 to 6.00 wt. % |
| acid-stable thickener, e.g. xanthane (polysaccaride) | 0.01 to 2.00 wt. % |
| dye, e.g. Hostafine Blue B 2 G C.I. 74160 | <0.01 wt. % |
| acid-stable perfume | 0.1 to 1.0 wt. % |
| tap water | ad 100 wt. % |
| Technical Data: | |
| Viscosity: | 500 to 1,000 mPas, 20° C. Rotovisko LVT, spindle 31, at 20 n/min |
| pH value (concentrated) | 0.5 to 2.5 |
| Receiving container B: Product with stabilised hydrogen peroxide phase with bleaching and disinfecting effect. | |
| non-ionic surfactant, e.g. fatty alcohol | 0.10 to 6.00 wt. % |

-continued

| | |
|---|---|
| ethoxylate $C_{13}$ 8EO | |
| hydrogen peroxide | 2.00 to 5.00 wt. % |
| ethanol | 1.0 to 6.0 wt. % |
| stabiliser, radical trap, mixture | 0.05 to 6.00 wt. % |
| dye, e.g. Hostafine Blue B 2 G C.I. 74160 | <0.01 wt. % |
| tap water | ad 100 wt. % |
| Technical Data: | |
| Viscosity: | 500 to 1,000 mPas, 20° C. Rotovisko LVT, spindle 31, at 20 n/min |
| pH value (concentrated) | 2.0 to 5.0 |

For this the combination of hydrogen peroxide and acidic, thickened cleaning agent with perfume cannot be realised in a single-chamber bottle, since due to the action of the peroxide the product stability is only low, which manifests itself in, for example, a strong, drop in viscosity and also in a change in the aromatic impression. However, the combination is desirable for the user in order to utilise, apart from the efficacy of the acid, also the bleaching and disinfecting action of the hydrogen peroxide; the use of a thickener causes a longer adhesion of the cleaning agent to the surface to be cleaned and thus an increase in the cleaning effect.

Example 2

Example 2 indicates different recipes of active fluids which can be used in a dispenser bottle according to the invention for washing dishes by hand or machine.

The dispenser bottle according to the invention enables not only increase in the storage stability of flowable substances or substance mixtures, particularly of machine or hand dishwashing agents, but through use of separate receiving containers the stability of the active substances contained in the agents can be improved by separation of chemically incompatible ingredients and, at the same time, this procedure also enables simple and economic preparation of ready-for-use flowable substances in the form of 'multi-phase' marketing formats. Through the route of multi-phase or multiple-phase form the co-operation of different active substances in machine dishwashing agents, for example, can thus be visualised.

The volume of the storage container is oriented towards, for example, inter alia the weight proportion or volume proportion of these active substances in the overall recipe of the machine dishwashing agent or the kind of ready-for-use preparation of these active substances, for example in the form of pure substance, as solution or dispersion. In a preferred form of embodiment all receiving containers have the same size, wherein the volume thereof is preferably between 10 and 2,000 milliliters, preferably between 20 and 1,500 milliliters, especially preferably between 50 and 1,000 milliliters and, in particular, between 100 and 800 milliliters.

Dispenser bottles according to the invention are suitable for repeated dosing of the flowable machine dishwashing agent and accordingly contain at least 2, but preferably at least 6, especially preferably at least 12, 24 or 36, dosing units.

The liquids contained in the packs according to the invention can be not only aqueous recipes, but also water-free recipes. Aqueous and water-free recipes can also be present separate from one another in a pack.

Commercially available aqueous machine dishwashing agents have a water content between 10 and 70 weight %, particularly preferably between 20 and 60 weight % and especially between 30 and 50 weight %, referred in each instance to the total weight of the aqueous machine dishwashing agent, whereas in the context of the present invention preferred water-free machine dishwashing agents have a water content below 6 weight %, preferably between 0.5 and 5 weight %, especially preferably between 1 and 4 weight %, referred in each instance to the total weight of the water-free machine dishwashing agent.

The liquid matrix of the aforesaid aqueous or water-free machine dishwashing agent can obviously also contain, apart from the water, further non-aqueous solvents. These non-aqueous solvents derive from, for example, the group of monoalcohols, diols, triols or polyols, the ethers, esters and/or amides. Particularly preferred in that case are non-aqueous solvents which are water soluble, wherein 'water soluble' solvents in the sense of the present invention are solvents which at room temperature are completely miscible with water, i.e. without miscibility gaps.

Non-aqueous solvents able to be used in dispenser bottles according to the invention preferably derive from the group of monovalent or multivalent alcohols, alkanolamines or glycol ethers, insofar as they are miscible with water in the indicated concentration range. The solvents are preferably selected from ethanol, n-propanol or iso-propanol, butanols, glycol, propanediol, butanediol, glycerol, diglycol, propyldiglycol, butyldiglycol, hexyleneglycol, ethyleneglycolmethylether, ethyleneglycolethylether, ethyleneglycolpropylether, ethyleneglycolmono-n-butylether, diethyleneglycolmethylether, diethyleneglycolethylether, propyleneglycolmethylether, propyleneglycolethylether, propyleneglycolpropylether, dipropyleneglycolmethylether, dipropyleneglycolethylether, methoxytriglycol, ethoxytriglycol, butoxytriglycol, 1-butoxyethoxy-2-propanol, 3-methyl-3-methoxybutanol, propyleneglycol-t-butylether as well as mixtures of these solvents.

In the context of the present invention particularly preferred flowable substances and/or substance mixtures are wherein they contain non-aqueous solvents in quantities of 0.1 to 70 weight %, preferably from 0.5 to 60 weight %, particularly preferably from 1 to 50 weight %, more particularly preferably from 2 to 40 weight % and, especially, from 2.5 to 30 weight %, referred in each instance to the flowable substance containing solvent or the flowable substance mixture, wherein preferred non-aqueous solvent or solvents is or are selected from the group of non-ionic surfactants liquid at room temperature, the polyethyleneglycols and polypropyleneglycols, glycerol, glycerol carbonate, triacetin, ethyleneglycol, propyleneglycol, propylenecarbonate, hexyleneglycol, ethanol, n-propanol and/or iso-propanol.

Apart from liquids, flowable solids, such as, for example, powder, granulate or microcompacts, are also applicable in the context of the present invention as flowable substances or substance mixtures. The stated solids can in that case be present in amorphous and/or crystalline and/or part-crystalline form. The particle size of these flowable solids preferably lies in the range of 10 to 2000 microns, particularly preferably in the range of 20 to 1,000 microns and especially in the range of 50 to 500 microns. Especially preferred are flowable solids in which at least 70 weight % of the particles, preferably at least 90 weight % of the particles, have a particle size below 1,000 microns, preferably below 800 microns, particularly preferably below 400 microns.

Further active substances preferably from the group of bleaching agents, bleach activators, polymers, builders, surfactants, enzymes, electrolytes, pH setting agents, aromatics, perfume vehicles, dyes, hydrotropes, foam inhibitors, anti-redeposition agents, antimicrobial active substances, germicides, fungicides, antioxidants as well as corrosion inhibitors can be contained in the flowable substances, which preferably contain one or more of the aforesaid non-aqueous solvents.

As previously explained, the dispenser bottle according to the invention is particularly suitable for separation of mutually incompatible ingredients of cleaning agents. The following table gives a non-exhaustive list of the separation of incompatible ingredients in multi-chamber bottles with two storage containers.

| Receiving container A | Receiving container B |
|---|---|
| bleaching agent | bleach activator |
| bleaching agent | enzyme |
| bleaching agent | anti-corrosion agent |
| bleaching agent | aromatic |
| bleaching agent | polymer |
| bleaching agent | nio-surfactant |
| bleaching agent | dye |
| bleaching agent | bleach activator, enzyme |
| bleaching agent | bleach activator, anti-corrosion agent |
| bleaching agent | bleach activator, aromatic |
| bleaching agent | bleach activator, polymer |
| bleaching agent | bleach activator, nio-surfactant |
| bleaching agent | bleach activator, dye |
| bleaching agent, bleach activator | enzyme |
| bleaching agent, bleach activator | anti-corrosion agent |
| bleaching agent, bleach activator | aromatic |
| bleaching agent, bleach activator | polymer |
| bleaching agent, bleach activator | nio-surfactant |
| bleaching agent, bleach activator | dye |

Example 3

Example 2 indicates various recipes of active fluids which can be used in a dispenser bottle according to the invention, also called multi-chamber container in the following, for washing textiles by hand or machine. Example 3 shows that it has been unexpectedly discovered that, from the viewpoints of storage stability and performance of the washing agent, in conditions of use an optimum results when a liquid washing agent composition is used which consists of at least two aqueous part compositions kept separately from one another, wherein a first part composition contains organic peracid and a second part composition contains surfactant and enzyme.

Separation of the part compositions preferably takes place in that they are present in a dispenser bottle according to the invention as a multi-chamber container, wherein the number of chambers (receiving containers) of the container corresponds with the number of part compositions and in each one of the chambers only a respective one of the part compositions is present. A further subject of the invention is therefore a combination of a here-defined liquid washing agent composition consisting of at least two, preferably exactly two, part compositions as active fluids, and a dispenser bottle, wherein the number of chambers of the container corresponds with the number of part compositions and in each one of the chambers a respective one of the part compositions is present. The chambers are either of separate construction and connected together or are constructed integrally with one another. Each of the chambers has at least one, preferably exactly one, outlet in the form of an outlet nozzle, from which the part composition can issue from the respective chamber. This can take place by the action of gravitational force, i.e. inclination of the dispenser bottle so that the part compositions of the liquid washing agent composition flow out. In a further form of embodiment of the invention the dispenser bottle is compressible so that flowing out of the part compositions can be accelerated by pressure, which is exerted by, for example, the hand of a user, on the dispenser bottle. The outlet of a liquid washing agent container is usually provided with a closure cap, wherein in the case of the present invention the outlet of each chamber can be provided with an own closure cap or the closure cap can be so constructed that it closes several, especially all, outlets of the dispenser bottle. The dispenser bottle can have grip depressions or handles to facilitate handling by the user, wherein the handle can be fastened to one or more chambers, or can also be part of a chamber, or several chambers each form a handle and are so joined together that the dispenser bottle or the multi-chamber container can be gripped by the hand of the user.

It is achieved through separate storage in the dispenser bottle or the multi-chamber container that the part compositions of the liquid washing agent composition intermix only after departure from the outlets, for example during pouring into a conventional flushing-in chamber of a washing machine or into a dosing device to be introduced into the washing drum of such a washing machine, or when the agent is sprayed onto a textile surface needing cleaning, for example in the context of laundry pretreatment. In the case of the last-mentioned form of spraying-on it is preferred that the chambers of the multi-chamber container each have at least one, preferably exactly one, discharge nozzle and the nozzle channels of the discharge nozzles are, in fact, oriented substantially parallel to one another, but in that case have a cross-sectional constriction arranged asymmetrically with respect to the overall flow cross-section. The cross-sectional constrictions are preferably arranged at the mutually facing sides of the nozzle channels in such a manner that the part compositions issuing under pressure have twists directed towards one another. This means that through the subtle design of the discharge nozzles the flows, which issue from the discharge nozzles, of the part compositions flow in a curve onto one another to a certain extent and collide at a distance, which varies somewhat depending on the outflow pressure, from the discharge nozzles. The application field of the application region can then be disposed at that point, for example a dirty mark on an item of laundry. The dispenser bottle can consist of a material with a restoring characteristic and/or have a shape assisting restoration to the original form. It is particularly recommended to make the dispenser bottle from a resilient restoring plastics material. The material for the dispenser bottle or the multi-chamber container can be, for example, a polyolefin, especially polypropylene (PP), polyethylene (PE), polyvinylchloride (PVC) or polyethylene-terephthalate (PET), especially glycol-modified polyethylene-terephthalate (PETG). If desired, the material can also be single-coloured or multi-coloured, wherein the individual chambers of the multi-chamber container can have the same colour or colours or mutually different colours. Multi-chamber containers are known from, for example, International Patent Applications WO 02/22467 A1, WO 97/23087 A1, WO 96/12648 A1, WO 95/16023 A1 and WO 91/04923, German Patent Application DE 32 20 693 A1 and German Utility Model DE G 93 16 583 U1.

The liquid washing agent composition according to the invention does not contain any bleach activator.

Preferably the first part composition as first active substance consists substantially of water and the organic peracid, which can be dissolved in water, but particularly preferably present at least partly undissolved in finely divided form. The first part composition can, apart from that, also contain organic acids corresponding with the organic peracid as well as small quantities of usual stabilisers or bleaching agents, for example the vinylether-maleic-acid copolymers known from European Patent Application EP 1 074 607 as dispersants and/or non-ionic surfactants and/or complexing agents which are known from European Patent Specification EP 0 497 337 and counteract metallo-catalysed decomposition of the peracid. The content of organic peracid is preferably 1 weight % to 25 weight %, especially 2 weight % to 20 weight % and particularly preferably 3 weight % to 15 weight %, referred in each instance to the first part composition. The organic peracid can carry aliphatic and/or cyclic groups, amongst them heterocyclic and/or aromatic groups. Coming into consideration are, for example, peroxoformic acid, peroxoacetic acid, peroxopropionic acid, peroxohexanoic acid, peroxobenzoic acid and substituted derivatives thereof, such as m-chlorperoxobenzoic acid, monoperoxophthalic acid, diperoxophthalic acid, 1,12-diperoxododecanoic acid, nonylamidoperoxoadipinic acid, 6-hydroxyperoxohexanoic acid, 4-phthalimidoperoxobutanoic acid, 5-phthalimidoperoxopentanoic acid, 6-phthalimidoperoxohexanoic acid, 7-phthalimidoperoxoheptanoic acid, N,N'-terephthaloyl-di-6-aminoperoxohexanoic acid and mixtures thereof. Belonging to the preferred peracids is 6-phthalimidoperoxohexanoic acid. The first part composition preferably has an acidic pH value, especially in the range of pH 1.5 to pH 5 and especially preferably from pH 2.5 to pH 4.5, which can result from the presence of the organic peracid or be set by addition of system-compatible acids. The first part composition does not contain any hydrogen peroxide. By that it is to be understood that it contains at most such a small quantity of hydrogen peroxide as may result through hydrolysis of the organic peracid. If desired, the first part composition in one form of embodiment of the invention can contain anionic surfactant, which is compatible with the organic peracid, in quantities of up to 50 weight %, particularly 10 weight % to 30 weight %, referred in each instance to the first part composition.

The second part composition as second active fluid or each of the optional further part compositions contains, apart from surfactant, at least one enzyme and is free of oxidatively acting bleaching agents. Mixtures of non-ionic and anionic surfactant are particularly preferred, wherein the second part composition or each of the optional further part compositions can contain a mixture of non-anionic and anionic surfactant or at least the second part composition can contain non-ionic surfactant and at least one further part composition can contain anionic surfactant. Equally, enzyme mixtures can be present in the part compositions or several enzymes can be so distributed to the second and further part compositions that each of them contains only one enzyme. The second composition or at least one of the further part compositions can be alkaline, so that after pouring out from the multi-chamber container, i.e. on bringing together all part compositions, a preparation results which has a pH value of preferably 4.5 to 10, preferably 5 to 9. The second part composition preferably contains 8 weight % to 70 weight %, particularly 20 weight % to 55 weight %, of water.

Belonging to the surfactants contained in the second part composition or the further part compositions are, in particular, anionic surfactants and non-ionic surfactants, although also cationic surfactants and ampholytic surfactants can be used.

As anionic surfactants there are preferably used one or more substances from the group of carboxylic acids, sulphuric acid semi-esters and sulfonic acids, preferably from the group of fatty acids, fatty alkyl sulphuric acids and alkylarylsulfonic acids. In order to have sufficient surface-active characteristics, the said compounds should in that case have longer-chain hydrocarbon groups, thus have at least 6 carbon atoms in the alkyl group or alkenyl group. The carbon chain distributions of the anionic surfactants usually lie in the region of 6 to 40, preferably 8 to 30 and especially 12 to 22, carbon atoms.

Carboxylic acids, which find use in the form of their alkali metal salts as soaps in washing and cleaning agents, are for the most part obtained from natural fats and oils by hydrolysis. Whereas alkaline saponification already carried out in the last century led directly to alkali salts (soaps), today only water is used for large scale separation, which separates the fat into glycerol and the free fatty acids. Methods used on a large scale are, for example, separation in autoclaves or continuous high-pressure separation. Carboxylic acids usable as anionic surfactant in acidic form in the context of the present invention are, for example, hexanoic acid (caproic acid), heptanoic acid (oenanthic acid), octanoic acid (caprylic acid), nonanoic acid (pelargonic acid), decanoic acid (capric acid), undecanoic acid, etc. Within the scope of the present invention use is preferred of fatty acids such as dodecanoic acid (lauric acid), tetradecanoic acid (myristic acid), hexadecanoic acid (palmitic acid), octadecanoic acid (stearic acid), eicosanoic acid (arachic acid), docosanoic acid (behenic acid), tetracosanoic acid (lignocerinic acid), hexacosanoic acid (cerotic acid), triacotanoic acid (melissio acid) as well as the unsaturated species 9c-hexadecenoic acid (palmitoleic acid), 6c-octadecenoic acid (petroselic acid), 6t-octadecenoic acid (petroselaidic acid), 9c-octadecenoic acid (oelic acid), 9t-octadecenoic acid (elaidic acid), 9c,12c-octadecadienoic acid (linoleic acid), 9t,12t-octadecadienoic acid (linolaidic acid) and 9c,12c,15c-octadecatreinoic acid (linolenic acid). For reasons of cost it is preferred not to use the pure species, but technical mixtures of the individual acids such as are available from fat-splitting. Such mixtures are, for example, coconut oil fatty acid (ca. 6 wt. % C8, 6 wt. % C10, 48 wt. % C12, 18 wt. % C14, 10 wt. % C16, 2 wt. % C18, 8 wt. % C18', 1 wt. % C18"), palm kernel oil fatty acid (ca. 4 wt. % C8, 5 wt. % C10, 50 wt. % C12, 15 wt. % C14, 7 wt. % C16, 2 wt. % C18, 15 wt. % C18', 1 wt. % C18"), tallow fatty acid (ca. 3 wt. % C14, 26 wt. % C16, 2 wt. % C16', 2 wt. % C17, 17 wt. % C18, 44 wt. % C18', 3 wt. % C18", 1 wt. % C18'"), hardened tallow fatty acid (ca. 2 wt. % C14, 28 wt. % C16, 2 wt. % C17, 63 wt. % C18, 1 wt. % C18'), technical oelic acid (ca. 1 wt. % C12, 3 wt. % C14, 5 wt. % C16, 6 wt. % C16', 1 wt. % C17, 2 wt. % C18, 70 wt. % C18', 10 wt. % C18", 0.5 wt. % C18'"), technical palmitic/stearic acid (ca. 1 wt. % C12, 2 wt. % C14, 45 wt. % C16, 2 wt. % C17, 47 wt. % C18, 1 wt. % C18') and soya bean oil fatty acid (ca. 2 wt. % C14, 15 wt. % C16, 5 wt. % C18, 25 wt. % C18', 45 wt. % C18", 7 wt. % C18'").

Sulfuric acid semi-esters of longer-chain alcohols are similarly anionic surfactants and usable in the context of the present invention. Their alkali metal salts, particularly sodium salts, i.e. the so-called fatty alcohol sulfates, are available on a large scale from fatty alcohols which are converted by sulfuric acid, chlorosulfonic acid, amidosulfonic acid or sulfuric trioxide to the relevant alkyl sulfuric acids and subsequently neutralised. The fatty alcohols are in that case obtained from the relevant fatty acids or fatty acid mixtures by high-pressure hydrogenisation of the fatty acid methyl esters. The industrial process of the greatest significance in terms of quantity for production of fatty alkyl sulfuric acids is sulfonation of alcohols by $SO_3$/air mixtures in special cascade, falling-film or tube-bundle reactors.

A further class of anionic surfactants able to be used in accordance with the invention are the alkylether sulfuric acids, the salts of which—the so-called alkylether sulfates—are distinguished by comparison with alkyl sulfates by a higher degree of water solubility and lower sensitivity relative to water hardness (solubility of the Ca salts). Alkylether sulfuric acids are, like alkyl sulfuric acids, synthesised from fatty alcohols which are converted by ethylene oxide to the relevant fatty alcohol ethoxylates. Propylene oxide can also be used instead of ethylene oxide. Subsequent sulfonation by gaseous sulfuric trioxide in short-time sulfonation reactors delivers yields above 98% of the relevant alkylether sulfuric acids.

In addition, alkane sulfonic acids and olefin sulfonic acids are usable in the context of the present invention as anionic surfactants in acidic form. Alkane sulfonic acids can contain the sulfonic acid group terminally bonded (primary alkane sulfonic acids) or along the carbon chain (secondary alkane sulfonic acids), wherein merely the secondary alkane sulfonic acids have commercial significance. These are produced by sulfochlorination or sulfoxidation of linear hydrocarbons. In the case of sulfochlorination according to Reed, n-paraffins are converted to the corresponding sulfochlorides by sulfuric dioxide and chlorine under irradiation by ultraviolet light, which in the case of hydrolysis by alkalis delivers the alkane sulfonate directly and in the case of conversion by water delivers the alkane sulfonic acids. Since, in the case of sulfochlorination, disulfochlorides and polysulfochlorides as well as chlorinated hydrocarbons can occur as secondary products of the radical reaction, the reaction is usually carried out only up to conversion degrees of 30% and thereafter interrupted.

Another process for producing alkane sulfonic acids is sulfoxidation, in which the n-paraffins are converted, under irradiation by ultraviolet light, by sulfuric dioxide and oxygen. In the case of this radical reaction, successive alkylsulfonyl radicals, which further react with oxygen to form the alkylpersulfonyl radicals, are created. Reaction with unconverted paraffin delivers an alkyl radical and the alkylpersulfonic acid, which decomposes into an alkylperoxysulfonyl radical and a hydroxyl radical. Reaction of the two radicals with unconverted paraffin delivers the alkylsulfonic acids or water, which reacts with alkylpersulfonic acid and sulfuric dioxide to form sulfuric acid. In order to keep the yield of the two end products of alkylsulfonic acid and sulfuric acid as high as possible and to suppress secondary reactions, this reaction is usually carried out only up to conversion degrees of 1% and thereafter interrupted.

Olefin sulfonates are technically produced by reaction of α-olefins with sulfuric trioxide. Intermediate zwitterions thereby form, which cyclise to form so-called sultones. Under suitable conditions (alkaline or acidic hydrolysis), these sultones react to form hydroxylalkanesulfonic acids or alkenesulfonic acids, which can both similarly be used as anionic surfactant acids.

Alkylbenzolsulfonates as high-performance anionic surfactants have been known since the thirtieth year of our century. At that time alkylbenzols, which were sulfonated by oleum and neutralised by sodium hydroxide solution, were produced by monochlorination of Kogasin fractions and subsequent Friedel-Crafts alkylation. At the beginning of the fiftieth year, in order to produce alkylbenzolsulfonates propylene was tetramerised to form branched α-dodecyclene and the product converted, by way of a Friedel-Crafts reaction with use of aluminium trichloride or fluorohydrocarbon, to form tetrapropylenebenzol, which was subsequently sulfonated and neutralised. This economic possibility for production of tetrapropylenebenzolsulfonates (TPS) led to a breakthrough of this surfactant class, which subsequently displaced soaps as the principal surfactant in washing and cleaning agents.

Due to the lack of biological degradability of TPS the need existed to demonstrate new alkylbenzolsulfonates distinguished by improved ecological properties. These requirements are fulfilled by linear alkylbenzolsulfonates which today are almost the exclusively produced alkylbenzolsulfonates and are denoted by the abbreviations ABS and LAS.

Linear alkylbenzolsulfonates are produced from linear alkylbenzols which in turn are available from linear olefins. For this purpose, large-scale petroleum fractions are separated by molecular sieving into the n-paraffins of the desired purity and hydrogenated to form the n-olefins, wherein not only α-olefins, but also i-olefins result. The olefins which arise are then converted, in the presence of acidic catalysts, by benzol to form the alkylbenzols, wherein selection of the Friedel-Crafts catalyser has an influence on the isomeric distribution of the linear alkylbenzols which are created: In the case of use of aluminium trichloride, the content of 2-phenyl-isomers in the mixture with the 3-, 4-, 5- and other isomers lies at approximately 30 weight %, whereagainst if fluorohydrocarbon is used as catalyser the content of 2-phenyl-isomer can drop to approximately 20 weight %. Sulfonation of the linear alkylbenzols finally takes place today on a large scale by oleum, sulfuric acid or gaseous sulfuric trioxide, wherein the last-mentioned has by far the greatest significance. Special film or tube-bundle reactors are used for the sulfonation and deliver, as product, a 97 weight percentage alkylbenzolsulfonic acid (ABSS).

The most diverse salts, i.e. alkylbenzolsulfonates, can be obtained from ABSS by selection of the neutralisation agent. For reasons of economy it is preferred in this connection to produce and use the alkali metal salts and, amongst these, preferably the sodium salts of ABSS. These can be described by the following general formula:

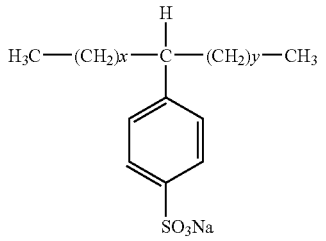

in which the sum of x and y usually lies between 5 and 13. According to the invention, C8-16-alkybenzolsulfonic acids, preferably C9-13-alkylbenzolsulfonic acids, are preferred as anionic surfactant in acid form. Further preferred for use in the context of the present invention are C8-16-alkybenzolsulfonic acids, preferably C9-13-alkylbenzolsulfonic acids, deriving from alkylbenzols having a tetralin content below 5 weight % referred to the alkylbenzol. In addition, it is preferred to use alkylbenzolsulfonic acids, the alkylbenzols of which were produced by the HF method so that the C8-16-alkylbenzolsulfonic acids, preferably C9-13-alkylbenzolsulfonic acids, used have a content of 2-phenyl-isomer below 22 weight % referred to the alkylbenzolsulfonic acid.

The stated anionic surfactants can be used alone or in mixture together, wherein mixtures of fatty acids and ether sulfates, particularly in weight ratios of 5:1 to 1:5, preferably 2:1 to 1:2, are particularly preferred. The anionic surfactants predominantly present in their acid form are usually used partly or fully neutralised. Offering themselves as cations for the anionic surfactants are, apart from the alkali metals (here, particularly, sodium and potassium salts), ammonium ions as well as monoethanol, diethanol or triethanol ammonium ions.

Instead of monoethanol, diethanol or triethanol amine, the analogous agent of monomethanol, dimethanol or trimethanol amine or such of alkanol amines of higher alcohols can be quaternised and added as cation.

As non-ionic surfactants there are preferably used alkoxylated, advantageously ethoxylated, particularly primary, alcohols preferably with 8 to 18 carbon atoms and on average 1 to 12 mol of ethylene oxide (EO) per mol of alcohol, in which the alcohol group can be linear or preferably methyl-branched at 2 position or can contain linear and methyl-branched groups in the mixture, just as are usually present in oxoalcohol groups. However, alcohol ethoxylates with linear groups of alcohols of natural origin with 12 to 18 carbon atoms, for example from coconut, palm, tallow-fat or oleyl alcohol and on average 2 to 8 EO per mol of alcohol are preferred. Belonging to the preferred ethoxylated alcohol are, for example, C12-14 alcohols with 3 EO or 4 EO, C9-11 alcohol with 7 EO, C13-15 alcohols with 3 EO, 5 EO, 7 EO or 8 EO, C12-18 alcohols with 3 EO, 5 EO, or 7 EO and mixtures of these, such as mixtures of C12-14 alcohol with 3 EO and C12-18 alcohol with 5 EO. The indicated degrees of ethoxylation represents statistical mean values which can, for a special product, be a whole or fractional number. Preferred alcohol ethoxylates have a restricted homologous distribution (narrow-range ethoxylates, NRE). In addition to these non-ionic surfactants, fatty alcohols with more than 12 EO can be used. Examples of such are tallow-fat alcohol with 14 EO, 25 EO, 30 EO or 40 EO. In addition, use can be made of weakly foaming non-ionic surfactants having ethylene oxide and alkylene oxide units in alternation. Amongst these there is again preference for surfactants with EO-AO-EO-AO blocks, wherein in each instance one to ten EO groups or AO groups are bonded together before a block from the respective other group follows. Examples thereof are surfactants of the general formula $$R^1-O-(CH_2-CH_2-O)_w-(CH_2-\underset{\underset{R^2}{|}}{CH}-O)_x-(CH_2-\underset{\underset{R^3}{|}}{CH_2}-O)_y-(CH_2-CH-O)_z-H$$

in which $R^1$ stands for a straight-chain or branched, saturated or single or multiple unsaturated C6-24 alkyl group or C6-24 alkenyl group; each group $R^2$ and $R^3$ is selected independently of one another from $-CH_3$, $CH_2CH_3$, $-CH_2CH_2-CH_3$, $CH(CH_3)_2$; and the indices w, x, y, z independently of each other stand for whole numbers from 1 to 6. These can be produced by known methods from the corresponding alcohols $R^1$—OH and ethylene oxide or alkylene oxide. The group $R^1$ in the foregoing formula can vary according to the respective origin of the alcohol. If natural sources are used, the group $R^1$ has an even number of carbon atoms and is, as a rule, unbranched, wherein the linear groups of alcohols of natural origin with 12 to 18 carbon atoms, for example coconut, palm, tallow-fat or oleyl alcohol, are preferred. Alcohols available from synthetic sources are, for example, the Guerbet alcohols or, in 2 position, methyl-branched or linear and methyl-branched groups in the mixture, thus as usually present in oxoalcohol groups. Independently of the form of alcohol used for producing the nio-surfactant contained in the agents in accordance with the invention there are preferred, in accordance with the invention, agents in which $R^1$ in the foregoing formula stands for an alkyl group with 6 to 24, preferably 8 to 20, particularly preferably 9 to 15 and especially 9 to 11, carbon atoms. As alkylene oxide unit, which can be present in the nio-surfactants in alternation with the ethylene oxide unit, there comes into consideration, apart from propylene oxide, especially butylene oxide. However, other alkylene oxides, in which $R^2$ and $R^3$ are selected independently of one another from $-CH_2CH_2-CH_3$ or $CH(CH_3)_2$, are also suitable.

Moreover, alkylglycosides of the general formula $RO(G)_x$ can be used as non-ionic surfactants, in which R signifies a primary straight-chain or methyl-branched group, particularly-branched aliphatic group in 2 position with 8 to 22, preferably 12 to 18, carbon atoms and G stands for a glycose unit with 5 or 6 carbon atoms, preferably standing for glucose. The degree x of oligomerisation, which indicates the distribution of monoglycosides and oligoglycosides, is any number between 1 and 10; preferably x is 1.2 to 1.4.

A further class of preferably used non-ionic surfactants, which are employed either as a sole non-ionic surfactant or in combination with other non-ionic surfactants, is alkoxylated, preferably ethoxylated or ethoxylated and propoxylated, fatty acid alkylesters, preferably with 1 to 4 carbon atoms in the alkyl chain, particularly fatty acid methylesters.

In addition, non-ionic surfactants of the type of amine oxides, for example N-cocinalkyl-N,N-dimethylamine oxide and N-talgalkyl-N,N-dihydroxyethylamine oxide, and the fatty acid alkanolamide can be suitable.

Further suitable surfactants are polyhydroxy fatty acid amides of the following formula $$R-CO-\overset{\overset{R^1}{|}}{N}-[Z]$$

in which RCO stands for an aliphatic acyl group with 6 to 22 carbon atoms, $R^1$ stands for hydrogen, an alkyl group or a hydroxyalkyl group with 1 to 4 carbon atoms and [Z] stands for a linear or branched polyhydroxyalkyl group with 3 to 10 carbon atoms and 3 to 20 hydroxyl groups. The polyhydroxy fatty acid amides are known substances which can usually be obtained by reductive amination of a reducing sugar by ammonia, an alkyl amine or an alkanol amine and subsequent acylation by a fatty acid, a fatty acid alkylester or a fatty acid chloride.

Belonging to the group of polyhydroxy fatty acid amides are also compounds of the formula $$R-CO-\overset{\overset{R^1-O-R^2}{|}}{N}-[Z]$$

in which R stands for a linear or branched alkyl group or alkenyl group with 7 to 12 carbon atoms, $R^1$ stands for linear, branched or cyclic alkyl group or an aryl group with 2 to 8 carbon atoms and $R^2$ stands for a linear, branched or cyclic alkyl group or an aryl group or an oxy-alkyl group with 1 to 8 carbon atoms, wherein C1-4 alkyl groups or phenyl groups are preferred, and [Z] stands for a linear polyhydroxy alkyl group, the alkyl chain of which is substituted by at least two hydroxyl groups, or alkoxylated, preferably ethoxylated or propoxylated, derivatives of this group.

[Z] is preferably obtained by reductive amination of a reduced sugar, for example glucose, fructose, maltose, lactose, galactose, mannose or xylose. The N-alkoxy-ubstituted or N-aryloxy-substituted compounds can then be transformed into the desired polyhydroxy fatty acid amides through conversion by fatty acid methylesters in the presence of an alkoxide as catalyst.

Other non-ionic surfactants able to be used are the end-group-closed poly(oxyalkylated) surfactants of the formula $$R^1O[CH_2CH(R^3)O]_x[CH_2]_kCH(OH)[CH_2]_jOR^2$$

in which $R^1$ and $R^2$ stand for linear or branched, saturated or unsaturated, aliphatic or aromatic hydrocarbon groups with 1 to 30 carbon atoms, $R^3$ stands for H or a methyl, ethyl, n-propyl, iso-propyl, n-butyl, 2-butyl or 2-methyl-2-butyl group, x stands for values between 1 and 30, and k and j stand for values between 1 and 12, preferably between 1 and 5. When the value x is equal to or greater than 2, each $R^3$ in the foregoing formula can be different. $R^1$ and $R^2$ are preferably linear or branched, saturated or unsaturated, aliphatic or aromatic hydrocarbon groups with 6 to 22 carbon atoms, wherein groups with 8 to 18 carbon atoms are particularly preferred. H, —$CH_3$ and —$CH_2CH_3$ are particularly preferred for the group $R^3$. Particularly preferred values for x lie in the range of 1, to 20, especially from 6 to 15.

Amongst non-ionic surfactants, preference is for mixtures of alkoxylated fatty alcohols and alkylglycosides. Therein, the weight ratio of them is preferably 10:1 to 1:2, particularly 10:1 to 2:1.

It is particularly preferred if the weight ratio of anionic surfactant to non-ionic surfactant is between 10:1 and 1:10, preferably between 7.5:1 and 1:5 and especially between 5:1 and 1:2. It is preferred if surfactant is present in amounts of 5 weight % to 80 weight %, preferably from 7.5 weight % to 70 weight %, particularly preferably from 10 weight % to 60 weight % and, in particular, from 12.5 weight % to 50 weight %. The indicated quantities and ratios refer in one form of embodiment of the invention to the individual (second or further) part compositions and in a further form of embodiment to the entire agent according to the invention.

Protease, amylase, lipase, hemicellulase and/or cellulase, in particular, belongs or belong to the enzymes present in the second part composition or the further part compositions. These enzymes are, in principle, of natural origin; starting from natural molecules, improved variants are available for use in washing and cleaning agents and are correspondingly preferred for use. Agents according to the invention contain enzymes in the second part composition or the further part compositions preferably in total mounts of 1×10−6 to 5 weight percent referred to active protein. The protein concentration can be determined with the help of known methods, for example the BCA method (bicinchonine acid; 2,2'-cichinolyl-4,4'-dicarboxylic acid) or the Biuret method (A. G. Gornall, C. S. Bardawill and M. M. David, J. Biol. Chem. 177 (1948), pp. 751-766). The first part composition is free of enzymes. In a preferred form of embodiment of the agent according to the invention the second part composition contains protease, amylase and cellulase. In this case, further part compositions (i.e., apart from the first) can be entirely absent.

With regard to proteases, preference is for those of the subtilisin type. Examples thereof are the subtilisins BNP' and Carlsberg, protease PB92, subtilisins 147 and 309, alkaline protease from *Bacillus lentus*, subtilisin DY and the enzymes thermitase, proteinase K and proteases TW3 and TW7, which, however, can no longer be associated with subtilisins in the narrower sense. Subtilisin Carlsberg is available in developed form under the trade name 'Alcalase'$^R$ from the company Novozymes A/S, Bagsvaerd, Denmark. Subtilisines 147 and 309 are sold under the trade names 'Esperase'$^R$ and 'Savinase'$^R$ by the company Novozymes. Variants under the designation 'BLAP'$^R$ are derived from the protease of *Bacillus lentus* DMS 5483 (known from International Patent Application WO 91/02792) and are described particularly in International Patent Applications WO 92/21760, WO 95/23221 and in the German Patent Applications DE 101 21 463 and DE 101 53 792. Other usable proteases from various *Bacillus* sp. and *B. gibsonii* are evident from German Patent Applications DE 101 62 727, DE 101 63 863, DE 101 63 884 and DE 101 62 728. Further usable proteases are, for example, the enzymes available under the trade names 'Durazym'$^R$, 'Relase'$^R$, 'Everlase'$^R$, 'Nafizym'$^R$, 'Natalase'$^R$, 'Kannase'$^R$ and 'Ovozymes'$^R$ from the company Novozymes, under the trade names 'Purafect'$^R$, Purafect$^R$ OxP' and 'Properase'$^R$ from the company Genencor, under the trade name 'Protosol'$^R$ from the company Advanced Biochemicals Ltd., Thane, India, under the trade name 'Wuxi'$^R$ from the company Wuxi Snyder Bioproducts Ltd., China, under the trade names 'Proleather'$^R$ and 'Protease P'$^R$ from the company Amano Pharmaceuticals Ltd., Nagoya, Japan, and under the designation 'Proteinase K-16' from the company Kao Corp., Tokyo, Japan.

Examples of the amylases usable in accordance with the invention are the α-amylases from *Bacillus licheniformis*, from *B. amyloliquefaciens* or from *B. stearothermophilus*, as well as the developments thereof improved for use in washing and cleaning agents. The enzyme from *B. licheniformis* is available from the company Novozymes under the name 'Termamyl'$^R$ and from the company Genencor under the name 'Purastar'$^R$ ST'. Development products of this α-amylase are available from the company Novozymes under the trade names 'Duramyl'$^R$ and 'Termamyl'$^R$ ultra', from the company Genencor under the name 'Purastar$^R$ OxAm' and from the company Daiwa Seiko Inc., Tokyo, Japan, as 'Keistase'$^R$. The α-amylase from *B. amyloliquefaciens* is marketed by the company Novozymes under the name 'BAN' and derivative variants of α-amylase from *B. stearothermophilus* under the names 'BSG'$^R$ and 'Novamyl'$^R$ again by the company Novozymes. Moreover, the α-amylase from *Bacillus* sp. A 7-7 (DSM 12368) disclosed in International Patent Application WO 02/10356 and cyclodextrin-glucanotransferase (CGTase) from *B. agaradherens* (DSM 9948) disclosed in International Patent Application PCT/EP01/13278 are to be emphasised, as well as that, to which the sequence space of α-amylases belong, defined in German Patent Application DE 101 31 441 A1. Similarly, fusion products of the said molecules are usable, for example those known from German Patent Application DE 101 38 753. Beyond that, the developments of α-amylase from *Aspergillus niger* and *A. oryzae* available under the trade name 'Fungamyl'$^R$ from the company Novozymes are suitable. A further commercial product is, for example, 'Amylase-LT'$^R$.

Agents according to the invention can contain lipases and/or cutinases. Belonging to these are, for example, the lipases originally obtained or developed from *Humicola lanuginosa* (*Thermomyces lanuginosus*), particularly such with the amino acid substitution D96L. They are sold, for example, by the company Novozymes under the trade names 'Lipolase'$^R$, 'Lipolase$^R$ Ultra', 'LipoPrime'$^R$, 'Lipozyme'$^R$ and 'Lipex'$^R$. Moreover, cutinases which were originally isolated from

*Fusarium solani pisi* and *Humicola insolens* are, for example, usable. Equally usable lipases are available from the company Amano under the designations 'Lipase CE'$^R$, 'Lipase P'$^R$, 'Lipase B'$^R$ or 'Lipase CES'$^R$, 'Lipase AKG'$^R$, 'Bacillus sp. Lipase'$^R$, 'Lipase AP'$^R$, 'Lipase M-AP'$^R$ and 'Lipase AML'$^R$. Lipases or cutinases which are from the company Genencor and the starting enzymes of which have been originally isolated from *Pseudomonas mendocina* and *Fusarium solanii*, for example, are usable. The preparations 'M1 Lipase'$^R$ and 'Lipomax'$^R$ originally marketed by the company Gist-Brocades and the enzymes marketed under the names 'Lipase MY-30'$^R$, 'Lipase OF'$^R$ and 'Lipase PL'$^R$ marketed by the company Meito Sangyo KK, Japan, as well as the product 'Lumafast'$^R$ by the company Genencor, may be mentioned as further important commercial products.

Agents according to the invention can contain cellulases, according to the respective purpose as pure enzymes, as enzyme preparations or in the form of mixtures in which the individual components are advantageously enhanced with respect to their different performance aspects. Counting amongst these performance aspects are, in particular, contributions to primary washing performance and to secondary washing performance of the agent (anti-redisposition effect or inhibition of greying) and softening (fabric action), as far as exertion of a 'stone-washed' effect. A usable mushroom-like endogluconase(EG)-rich cellulase preparation or developments thereof are offered by the company Novozymes under the trade name 'Celluzyme'$^R$. There are also the products 'Endolase' and 'Carezyme'$^R$ based on 50 kD-EG and 43 kD-EG, respectively, from *H. insolens* DSM 1800 available from the company Novozymes. Other commercial products of this company are 'Cellusoft'$^R$ and 'Renozyme'$^R$. Equally usable are the cellulases disclosed in International Patent Application WO 97/14804; for example, the 20 kD-EG from Melanocarpus, which is disclosed therein and which is available from the company AB Enzymes, Finland, under the trade names 'Ecostone'$^R$ and 'Biotouch'$^R$. Other commercial products of the company AB Enzymes are 'Econase'$^R$ and 'Ecopulp'$^R$. Further suitable cellulases from *Bacillus* sp. CBS 670.93 and CBS 669.93 are disclosed in International Patent Application WO 96/34092, wherein that from *Bacillus* sp. CBS 670.93 is available from the company Genencor under the trade name 'Puradax'$^R$. Other commercial products of the company Genencor are 'Genencor detergent cellulase L' and 'IndiAge$^R$ Neutra'.

Agents according to the invention can contain further enzymes which are summarised by the term hemicellulases. Belonging thereto are, for example, mannanases, xanthanlyases, pectinlyases (=pectinases), pectinesterases, pectatlyases, xyloglucanases (=xylanases), pullulanases and β-glucanases. Suitable mannanases are, for example, available under the names 'Gamanase'$^R$ and 'Pektinex AR'$^R$ from the company Novozymes, under the names 'Rohapec$^R$ B1L' from the company AB Enzymes and under the name 'Pyrolase' from the company Diversa Corp., San Diego, Calif., USA. A suitable β-glucanase from a *B. alcalophilus* is evident from, for example, International Patent Application WO 99/06573. The β-glucanase obtained from *B. subtilis* is available under the name 'Cereflo'$^R$ from the company Novozymes.

The enzymes used in the agents according to the invention derive either originally from micro-organisms, for example of the categories *Bacillus, Streptomyces, Humicola* or *Pseudomonas*, and/or are produced by a biotechnological method, which is known per se, by suitable micro-organisms, for example by transgenic expression hosts of the species *Bacillus* or filamentary fungi.

An enzyme contained in an agent according to the invention can be protected, particularly during storage, against damage such as, for example, inactivation, denaturisation or decomposition by, for example physical influences, oxidation or proteolytic separation. Agents according to the invention can contain enzyme stabilisers for this purpose. One group of enzyme stabilisers is reversible protease inhibitors. Use is frequently made of benzamidine-hydrochloride, borax, boric acids, boron acids or the salts or esters thereof, amongst those primarily derivatives with aromatic groups, for example according to the International Patent Application WO 95/12655 ortho-substituted, according to International Patent Application WO 92/19707 meta-substituted and according to US Patent U.S. Pat. No. 5,972,873 para-substituted phenylboron acids or the salts or esters thereof. Peptide-aldehydes, i.e. oligo-peptides with reduced C termination, are disclosed for the same purpose in International Patent Application WO 98/13460 and European Patent Application 583 534. As peptidic protease inhibitors mention may be made of, inter alia, ovomucoid (according to International Patent Application WO 93/00418) and leupeptin; an additional option is formation of fusion proteins from proteases and peptide inhibitors. Further enzyme stabilisers are amino alcohols such as monoethanol, diethanol, triethanol, monopropanol, dipropanol and tripropanol amine and mixtures thereof, aliphatic carboxylic acids up to C12, for example from European Patent Application EP 0 378 261 or International Patent Application WO 97/05227, such as succinic acid, and other dicarboxylic acids or salts of the said acids. Fatty acid amide alkoxylates closed at end groups are disclosed for this purpose in German Patent Application DE 196 50 537. Organic acids used as intended as builders are capable, as disclosed in International Patent Application WO 97/18287, of additionally stabilising a contained enzyme. Lower aliphatic alcohols such as ethanol or propanol, but above all polyols, such as, for example, glycerol, ethyleneglycol, propyleneglycol or sorbitol are further enzyme stabilisers. According to European Patent Application EP 0 965 268 diglycerol phosphate also protects against denaturisation by physical influences. Equally, calcium salts are frequently used, such as, for example, calcium acetate or the calcium formiate disclosed for this purpose in European Patent Specification EP 0 028 865, and magnesium salts, for example according to European EP 0 378 262. Reduction agents and anti-oxidants increase, as disclosed inter alia in European Patent Application EP 0 780 466, the stability of enzymes relative to oxidative decomposition. Reduction agents containing sulphur are known from, for example, European Patent Specifications EP 0 080 748 and EP 0 080 223. Other examples thereof are sodium sulfite (according to European Patent Application EP 0 533 239) and reducing sugar (according to European Patent Application EP 0 656 058).

Preferably use is made of combinations of stabilisers, for example of polyols, boric acids and/or borax according to International Patent Application WO 96/31589, the combination of boric acid or borate, reducing salts and succinic acid or other dicarboxylic acids according to European Patent Application EP 0 126 505 or the combination of boric acid or borate with polyols or polyamino compounds and with reducing salts, as disclosed in European Patent Application EP 0 080 223. The action of peptide-aldehyde stabilisers is increased, according to International Patent Application WO 98/13462, by combination with boric acid and/or boric acid derivatives and polyols and further reinforced according to International Patent Application WO 98/13459 by additional use of bivalent cations, such as, for example, calcium ions.

The second part composition or the further part compositions can, beyond that, contain all ingredients which are usual in liquid washing agents and which do not negatively interact with the said agents in inappropriate manner. Belonging thereto are, for example, builder materials, complexing agents for heavy metals, non-aqueous water miscible solvents, thickening agents, greying inhibitors, foam regulators, colour transfer inhibitors, antimicrobial active ingredients, optical brighteners, colorants and aromatics. If desired, such further ingredients can also be present in the first part composition insofar as they do not inappropriately prejudice the storage stability of the peracid components.

As builder materials which can be present in the agents according to the invention mention can be made of, in particular, silicates, aluminium silicates (particularly zeolites), carbonates, salts of organic dicarboxylic and polycarboxylic acids as well as mixtures of these substances.

Suitable crystalline, layer-forming sodium silicates have the general formula $Na_MSi_xO_{2x+1}.yH_2O$, wherein M signifies sodium or hydrocarbon, x is a number from 1, 9 to 4 and y is a number from 0 to 20 and preferred values for x are 2, 3 and 4. Crystalline layer silicates of that kind are described in, for example, European Patent Application EP 0 164 514. Preferred crystalline layer silicates of the indicated formula are such in which M stands for sodium and x has the value 2 or 3. Particularly preferred are not only β-, but also δ-sodium disilicate $Na_2Si_2O_5.yH_2O$, wherein β-sodium disilicate can be obtained, for example, according to the method described in International Patent Application WO 91/08171.

Also usable are amorphic sodium silicates with a modulus $Na_2O:SiO_2$ of 1:2 to 1:3.3, preferably from 1:2 to 1:2.8 and, particularly, from 1:2 to 1:2.6, which are delayed in dissolution and have secondary washing characteristics. The delay in dissolution relative to conventional amorphic sodium silicates can in that case be produced in different ways, for example by surface treatment, compounding, compacting/compressing or by super-drying. In the context of this invention there is understood by the term 'amorphic' also X-ray-amorphic'. This means that the silicates in the case of X-ray diffraction experiments do not supply sharply defined X-ray reflexes as are typical for crystalline substances, but at most one or more maxima of the scattered X-ray radiation, which have a width of several degree units of the diffraction angle. However, very good, even particularly good, builder characteristics can be obtained if the silicon particles deliver washed-out or even sharp diffraction maxima in electron diffraction experiments. This is to be interpreted in the sense that the products have microcrystalline ranges of the magnitude 10 to a few hundred nanometers, wherein values up to a maximum of 50 nanometers and particularly up to a maximum of 20 nanometers are preferred. So-called X-ray amorphic silicates of that kind, which similarly have a delay in dissolution relative to conventional potassium silicates, are described in, for example, German Patent Application DE 44 00 024. Particularly preferred are compressed/compacted amorphic silicates, compounded amorphic silicates and super-dried X-ray-amorphic silicates.

The optionally used fine-crystalline synthetic zeolite containing bound water is preferably zeolite A and/or P. Zeolite 'MAP'$^R$ (commercial product of the company Crosfield) is particularly preferred as zeolite P. However, zeolite X as well as mixtures of A, X and/or P are also suitable. In addition, a co-crystallisate of zeolite X and zeolite A (approximately 80 weight % of zeolite X) which is marketed by the company CONDEA Augusta S.p.A. under the mark name 'VEGO-BOND AX'$^R$ and can be described by the formula $nNa_2O.(1-n)K_2O.Al_2O_3.(2\text{-}2.5)SiO_2.(3.5\text{-}5.5)H_2O$, for example, is commercially available and preferably usable in the context of the present invention. The zeolite can be used as a spray-dried powder or also as an undried stabilised suspension still moist from production thereof. If the zeolite is used as a suspension, this can contain small additives of non-ionic surfactants as stabilisers, for example 1 to 3 weight %, referred to zeolite, of ethoxylated C12-C18 fatty alcohols with 2 to 5 ethyleneoxide groups, C12-C14 fatty alcohols with 4 to 5 ethyleneoxide groups or ethoxylated isotridecanols. Suitable zeolites have a mean particle size of less than 10 microns (volume distribution; measuring method by means of, for example, Coulter Counter) and preferably contain 18 to 22 weight %, particularly 20 to 22 weight %, of bound water.

Obviously a use of the generally known phosphates as builder substances is also possible insofar as a use of that kind should not be avoided for ecological reasons. The sodium salts of orthophosphates, pyrophosphates and, in particular, tripolyphosphates are particularly suitable.

Organic builder substances able to be employed are, for example, polycarboxylic acids usable in the form of the sodium salts thereof, wherein by polycarboxylic acids there are understood such carboxylic acids which carry more than an acid function. These are, for example, citric acid, adipic acid, succinic acid, glutaric acid, malic acid, tartaric acid, maleic acid; fumaric acid, saccharic acids, amino carboxylic acids, nitrilo-triacetic acid (NTA), insofar as use thereof is not open to objection on ecological grounds, as well as mixtures of these. Preferred salts are the salts of polycarboxylic acids such as citric acid, adipic acid, succinic acid, glutaric acid, tartaric acid, saccharic acids and mixtures thereof. In addition, the acids can in themselves be used. The acids have, apart from their builder effect, typically also the characteristic of an acidification component and thus also serve for setting a lower and more moderate pH value of laundry or cleaning agents. In this connection, particular mention is made of citric acid, succinic acid, glutaric acid, adipic acid, gluconic acid and any mixtures thereof. Moreover, polymeric polycarboxylates are suitable as builders, these being, for example, the alkali metal salts of polyacryl acid or polymethacryl acid, for example those with a relative molecular mass of 500 to 70,000 g/mol. The molecular masses indicated for polymeric polycarboxylates are in the sense of the present specification mean-weight molecular masses Mw of the respective acid form which can be basically determined by means of gel permeation chromatography (GPC), in which an ultraviolet detector is used. The measuring is in that case carried out relative to an external polycacryl acid standard which on the basis of its structural affinity with the tested polymers delivers realistic molecular weight values. These statements significantly deviate from the molecular weight statements at which polystyrolsulfonic acids are used as standard, wherein the molecular masses measured relative to polystyrolsulfonic acids are, as a rule, significantly higher. Suitable polymers are, in particular, polyacrylates, which preferably have a molecular mass of 2,000 to 20,000 g/mol. By virtue of their superior solubility, short-chain polyacrylates having molecular masses from 2,000 to 10,000 g/mol, and particularly preferably from 3,000 to 5,000 g/mol, can in turn be preferred from this group. Moreover, copolymeric polycarboxylates, particularly these of acryl acid with methacryl acid and of acryl acid or methacryl acid with maleic acid, are also suitable. Copolymers of acryl acid with maleic acid, which contain 50 to 90 weight % of acryl acid and 50 to 10 weight % of maleic acid, have proved particularly suitable. Their relative molecular mass, referred to free acids, generally amounts to 2,000 to 70,000 g/mol, preferably 20,000 to 50,000 g/mol and, especially, 30,000 to 40,000 g/mol. For improvement in water solubility the polymers can also contain allylsulfonic acids such as, for example, allyloxybenzolsulfonic acid and methallylsulfonic acid known from European Patent Specification EP 0 727 448 B1, as monomer. Also particularly preferred are biologically degradable polymers from more than two different monomer units, for example those which according to German Patent Application DE 43 00 772 A1 contain, as monomers, salts of acryl acid and of maleic acid as well as vinylalcohol or vinylalcohol derivatives or according to German Patent Specification DE 42 21 381, as monomers, salts of acryl acid and 2-alkylallylsulfonic acid as well as sugar derivatives. Further preferred copolymers are those which are described in German Patent Applications DE-A-43 03 320 and DE-A-44 17 734 and preferably have, as monomers, acrolein and acryl acid/acryl acid salt or acrolein and vinylacetate. Equally to be mentioned as further preferred organic builder substances are polymeric aminodicarboxylic acids, the salts thereof and the precursor substances thereof. Particularly preferred are polyasparagine acids or salts and derivatives thereof, of which there is disclosure in German Patent Application DE 195 40 086 A1 that they have, apart from cobuilder characteristics, also a bleach-stabilising effect. Further suitable builder substances are polyacetals able to be obtained by conversion of dialdehydes by polyolcarboxylic acids having 5 to 7 carbon atoms and at least 3 hydroxyl groups, for example as described in European Patent Application EP 0 280 223. Preferred polyacetals are obtained from dialdehydes such as glyoxal, glutaraldehyde, terephthalaldehyde as well as mixtures thereof and from polyolcarboxylic acids such as gluconic and/or glucoheptone acid. Further suitable organic builder substances are dextrins, for example oligomers or polymers of carbohydrates able to be obtained by partial hydrolysis of starches. The hydrolysis can be carried out according to usual, for example acid-catalysed or enzyme-catalysed, methods. Hydrolysis products with mean molecular masses in the region of 400 to 500,000 g/mol are preferred. In that case a polysaccharide with a dextrose equivalent (DE) in the region of 0.5 to 40, particularly from 2 to 30, is preferred, wherein DE is a customary measure for the reducing action of a polysaccharide by comparison with dextrose, which has a DE of 100. There are usable not only maltodextrins with a DE between 3 and 20 and dry glucose syrup with a DE between 20 and 37, but also so-called yellow dextrins and white dextrins with higher molecular masses in the region of 2,000 to 30,000 g/mol. A preferred dextrin is described in European Patent Application EP 0 703 292 A1. The oxidised derivatives of dextrins of that kind are the conversion products thereof by oxidation agents, which are in a position of oxidising at least one alcohol function of the saccharide ring to form the carboxylic acid function. Oxidised dextrins of that kind and methods for the production thereof are known from, for example, European Patent Application EP 0 232 202, EP 0 427 349, EP 0 472 042 and EP 0 542 496 as well as International Patent Applications WO 92/18542, WO 93/08251, WO 93/16110, WO 94/28030, WO 95/07303, WO 95/12619 and WO 95/20608. Equally suitable is an oxidised oligosaccharide according to German Patent Application DE-A-196 00 018. A product oxidised at C6 of the saccharide ring can be particularly advantageous. In addition, oxydisuccinate and other derivatives of disuccinates, preferably ethylenediaminedisuccinate, are further suitable builder materials. In that case ethylenediamine-N,N'-disuccinate (EDDS), the synthesis of which is described in, for example, U.S. Pat. No. 3,158,615, is preferably used in the form of its sodium or magnesium salts. Moreover, also preferred in this connection are glycerinedisuccinate and glycerinetrisuccinate, such as, for example, described in US Patent Specifications U.S. Pat. No. 4,524,009 and U.S. Pat. No. 4,639,325, European Patent Application EP-A-0 150 930 and Japanese Patent Application JP 93/339896. Further usable organic builders are, for example, acetylated hydrocarbon acids or the salts thereof which, in a given case, can also be present in lactone form and which contain at least 4 carbon atoms and at least one hydroxy group as well at most two acid groups. Builders of that kind are described in, for example, International Patent Application WO 95/20029. Builder substances, and amongst these particularly water soluble materials, are present in agents according to the invention preferably in amounts of 1 weight % to 20 weight %, particularly from 1 weight % to 8 weight %, wherein the first part composition is preferably free of builder materials.

Belonging to the complex-formers, which are optionally present in the agents, for heavy metals are phosphoric acid, aminocarboxylic acids and optionally functionally modified phosphonic acids, for example hydroxyphosphonic acids or aminoalkanephosphonic acids. Nitrilo-triacetic acid, methylglycine-diacetic acid and diethylenetriamine-penta-acetic acid, for example, belong to the usable amino carboxylic acids. Coming into question under phosphonic acids are, for example, 1-hydroxyethane-1,1-diphosphonic acid (HEDP) or the disodium or tetrasodium salt of this acid, 2-phosphonobutane-1,2,4-tricarboxylic acid or the trisodium salt of this acid, ethylenediamine-tetramethylenephosphonic acid (EDTMP), diethylenetriamine-pentamethylenephosphonic acid (DTPMP) as well as the higher homologations thereof. In addition, the N-oxides corresponding with the said nitrogen-containing compounds can be used. Ethylenediamine-N-N'-disuccinic acid (EDDS) also belongs to the usable complex-formers. The said complex-formers in their acid form can be used as such or in the form of their alkali salts, particularly the sodium salts. The use of mixtures of aminocarboxylic acids with phosphonic acids is preferred. Complex-formers for heavy metals are present in agents according to the invention preferably in amounts of 0.05 weight % to 1 weight %, wherein if desired they can be present in the first part composition and/or in the second or the further part compositions.

Non-aqueous solvents which can be used in the agents according to the invention originate from, for example, the group of monovalent alcohols, the alkanolamines or glycolethers, insofar as they are miscible with water in the concentration range intended for use. The solvents are preferably selected from ethanol, n-propanol, i-propanol, butanols, ethyleneglycolmethylether, ethyleneglycolethylether, ethyleneglycolpropylether, ethyleneglycolmono-n-butylether, diethyleneglycol-methylether, diethyleneglycolethylether, propyleneglycolmethylether, propyleneglycolethylether, propyleneglycolpropylether, dipropyleneglycolmonomethylether, dipropyleneglycolmonoethylether, di-isopropyleneglycolmonomethylether, di-isopropylenegylcolmonoethylether, methoxytriglycol, ethoxytriglycol, butoxytriglycol, 1-butoxyethoxy-2-propanol, 3-methyl-3-methoxybutanol, propylene-glycol-t-butylether as well as mixtures of these solvents. Non-aqueous solvents can be used in the liquid washing agents according to the invention as desired in amounts up to 40 weight %, preferably from 0.5 to 20 weight % and particularly from 1 weight % to 10 weight %, wherein numbered amongst the said solvents are the quantities of those which simultaneously act as enzyme stabilisers.

Soaps, paraffins and silicon oils, for example, come into consideration as foam inhibitors able to be used in the agents according to the invention. Preferably, silicon oils are used.

Suitable antiredeposition agents, which are also termed soil repellents, are, for example, non-ionic cellulose ethers such as methylcellusone and methylhydroxypropylcellulose with a proportion of methoxy groups of 15 to 30 weight % and of hydroxypropyl groups of 1 to 15 weight % referred in each instance to the non-ionic cellulose ether, as well as polymers, which are known from the state of the art, of phthalic acid and/or terephthalic acid or derivatives thereof, especially polymers of ethyleneterephthalates and/or polyethyleneglycolterephthalates or anionic and/or non-ionic modified derivatives of these. Of those, there is particular preference for the sulfonated derivatives of phthalic acid and terephthalic acid polymers.

Optical brighteners can be added to the agents according to the invention in order to counteract greying and yellowing of the treated textiles. These substances attach to the fibres and produce a brightening and simulated bleach effect in that they convert invisible ultraviolet radiation into light of visible wavelength, wherein the ultraviolet light absorbed from the sunlight is irradiated as a weak bluish fluorescence and with the yellow tone of the greyed or yellowed laundry gives a pure white. Suitable compounds derive from, for example, the substance classes of 4,4'-diamino-2-2'-stilbendisulfonic acids (flavan acids), 4,4"-distyryl-biphenylene, methylumbelliferones, cumarines, dihydroquinolines, 1,3-diarylpyrazolines, naphthalic acid imides, benzoxazole, benzisoxazole and benzimidazole systems as well as pyrene derivatives substituted by heterocycles. The optical brighteners are usually used in amounts between 0.05 and 0.3 weight % referred to the finished agents.

Greying inhibitors have the task of keeping the dirt, which is detached from the fibres, suspended in the washing liquor and thus preventing reattachment of the dirt. For this purpose water-soluble colloids mostly or organic nature are suitable, particularly glue, gelatine, salts of ethersulfonic acids of starch or of cellulose or salts or acidic sulfuric acid esters of cellulose or of starch. In addition, water-soluble polyamides containing acidic groups are suitable for this purpose. Moreover, soluble starch preparations different from the above-mentioned starch products can be used, for example degraded starch, aldehyde starches, etc. Polyvinylpyrrolidone is also usable. Preferably, however, cellulose ethers such as carboxymethylcellulose (sodium salts), methylcellulose, hydroxyalkylcellulose and mixed ethers such as methylhydroxyethylcellulose, methylhydroxypropylcellulose, methylcarboxymethylcellulose and mixtures thereof in quantities of 0.1 to 5 weight %, referred to the agent are used.

Since area structures, particularly of rayon, rayon stable fibre, cotton and mixtures thereof, can tend to crease because individual fibres are sensitive to bending, kinking, pressing and crushing transversely to the fibre direction, the agent according to the invention can contain synthetic anti-creasing means which, however, are preferably not present in the first part composition. Numbered amongst these are, for example, synthetic products on the basis of fatty acids, fatty acid esters, fatty acid amides, fatty acid alkylol esters, fatty acid alkylol amides and fatty alcohols, which are mostly converted by ethylene oxide, or products on the basis of lecithin or modified phosphoric acid esters.

For combating microorganisms the agent according to the invention can contain antimicrobial active ingredients. In this connection distinction is made, according to the respective antimicrobial spectrum and working mechanism, between bacteriostatics and bactericides, fungistatics and fungicides, etc. Important substances from these groups are, for example, benzalkoniumchlorides, alkylarlylsufonates, halogenphenoles and phenolmercuriacetate, wherein in the case of the agents according to the invention it is also possible to entirely dispense with these compounds.

Thickening active ingredients usable in the part compositions according to the invention are, for example, those from the class of polyurethanes, polyacrylates, which can also be present at least partly cross-linked, polycarylamides and/or polysaccharides or the derivatives thereof. As polysaccharidic thickening active ingredient there comes into question, apart from carboxylated and/or alkoxylated cellulose, an optionally modified polymer of saccharides such as glucose, galactose, mannose, gulose, altrose, allose, etc. Preferably, a water-soluble xanthane as is commercially available, for example, under the product designations 'Kelzan'$^R$ 'Rhodopol'$^R$, 'Ketrol'$^R$ and 'Rheozan'$^R$ is used. By xanthane there is understood a polysaccharide corresponding with that produced by the bacterial origin *Xanthomonas campestris* from aqueous solutions of glucose or starch (J. Biochem. Microbiol. Technol. Engineer, Vol. III (1961), pp. 51 to 63). It consists substantially of glucose, marinose, glucuronic acid and the acetylation products thereof and additionally contains subordinate amounts of chemically bound pyruvic acid. The use of water-soluble polysaccharide derivatives, such as, for example, by oxalkylation with, for example, ethylene oxide, propylene oxide and/or butylene oxide, by alkylation with, for example, methylhalogenides and/or dimethylsulfate, by acylation with carboxylic acid halogenides or by saponifying desacetylation from which corresponding polysaccharides can be obtained, is also possible. Thickening active ingredients are contained in the agents according to the invention in amounts of preferably 0.05 weight % to 2.5 weight %, especially 0.1 weight % to 2 weight %, wherein the proportion thereof does not have to be the same in all part compositions.

The individual part compositions, particularly when only two are present, are preferably used in proportions of like amount. This can be achieved in simple manner by setting the viscosity of the part compositions and/or the form of the outflow openings of the chambers of the multi-chamber container, particularly adaptation of the diameter of the outflow openings, so that the user or the agent obtains, by simple pouring out or pressing out of the multi-chamber container, an immediately usable quantity, for example the quantity necessary for a washing process in a washing machine, of liquid washing agent.

Formulation Examples, for Multi-Component Liquid Washing Agents:

Through simple mixing of the ingredients, which are indicated in the following Table, in the indicated amounts (in weight % referred to the part composition) part compositions T1 and T2 containing surfactants and enzymes were produced. These were each filled into a chamber of a double-chamber bottle, which consists of two chambers of the same size (each of a volume of 750 ml) of polyethylene and the respective second chamber of the bottle was filled with the same amount of a 5 weight percent aqueous phthalimidoperoxohexanoic acid preparation P ('Eureco$^R$ L', manufacturer Ausimont).

TABLE part compositions containing surfactant and enzyme [wt. %]

| | T1 | T2 |
|---|---|---|
| non-ionic surfactant I[a)] | 24 | — |
| non-ionic surfactant II[b)] | — | 22.5 |
| anionic surfactant I[c)] | 16 | — |
| anionic surfactant II[d)] | — | 40 |
| Na-citrate | 2 | — |
| phosphonate[e)] | 0.5 | 0.6 |

TABLE-continued part compositions containing surfactant and enzyme [wt. %]

| | T1 | T2 |
|---|---|---|
| polyacrylate[f)] | 1 | — |
| protease[g)] | 1.4 | 1.6 |
| amylase[h)] | 0.1 | 0.2 |
| cellulase[i)] | 0.04 | 0.06 |
| Glycerol | 7.5 | 1 |
| Ethanol | 1 | 3.5 |
| propyleneglycol | — | 5 |
| Boric acid | 1 | — |
| dye and aromatics | 1.5 | 2.5 |
| Water | to 100 | to 100 |

[a)] $C_{12-16}$ fatty-alcohol-1,4-glucoside and 7-times ethoxylated $C_{12-18}$-fatty-alcohol, weight ratio 1:5
[b)] $C_{12-14}$-fatty-alcohol, 4-times propoxylated and 5-times ethoxylated
[c)] $C_{12-14}$-fatty-alcohol + 2-EO-sulfate-sodium salt and palm kernel oil fatty acid sodium salt, weight ratio 1:1
[d)] linear alkylbenzolsulfonate sodium salt and palm kernel oil fatty acid ethanolamine salt, weight ratio 1:1
[e)] diethylenetriaminepentamethylenephosphonic acid heptasodium salt
[f)] 'Acusol'[R] 820
[h)] 'Alcalase'[R] 2.5 L
[h)] 'Termamyl'[R] 300 L
[i)] 'Carezyme'[R] 4500 L By simple pouring out, 100 ml (corresponding with 50 ml of T1 or T2 and 50 ml of P) or 75 ml (corresponding with 37.5 ml of T1 or T2 and 37.5 ml of P) of the two-component agent was metered each time into the flushing-in chamber of a washing machine and textiles provided with standardised soiling washed therewith. For comparison, the part compositions T1 and T2 alone and also a commercially available universal washing agent compact powder were tested under the same conditions.

As used herein, and in particular as used herein to define the elements of the claims that follow, the articles "a" and "an" are synonymous and used interchangeably with "at least one" or "one or more," disclosing or encompassing both the singular and the plural, unless specifically defined otherwise. The conjunction "or" is used herein in its inclusive disjunctive sense, such that phrases formed by terms conjoined by "or" disclose or encompass each term alone as well as any combination of terms so conjoined, unless specifically defined otherwise. All numerical quantities are understood to be modified by the word "about," unless specifically modified otherwise or unless an exact amount is needed to define the invention over the prior art.

What is claimed is:

1. A dispenser bottle comprising a first receiving container for a first active fluid and at least a second receiving container for a second active fluid, wherein the receiving containers each have a respective outlet for the active fluid and the outlets are arranged adjacently such that the two active fluids can be applied in a common application field of an application region, and wherein the outlets each comprise a respective discharge nozzle, which nozzles are spaced from one another such that the active fluids intermix only after departing the discharge nozzles, wherein the nozzles each have cross-sectional constrictions arranged asymmetrically with respect to the associated nozzle cross-section to comprise means at the location of the constrictions, for increasing the flow speed of fluids being discharged through the nozzles, to impart a degree of twist to the fluids being discharged from the nozzles, wherein the receiving containers are compressible, wherein the receiving containers comprise a material that returns at least in part to original form after deformation, wherein the receiving containers are each formed as a complete container, connected only by at least one connecting web integrally connected at mutually facing inner sides of the receiving containers over substantially the full lengths of the receiving containers, and operating as a reinforcing means for stabilizing the mutually facing inner sides of the receiving containers and as a means for buttressing pressure forces exerted by the hand of a user when discharging active fluids from the containers, wherein the receiving containers together have a recessed holding region over a sufficiently large portion of the height of the container between vertically spaced ends to comprise means for facilitation grasping by a hand of a user for squeezing the containers and dispensing liquid from the containers, wherein the active fluids discharge from the nozzles and intermix at a predetermined distance after exiting the nozzles by hand pressure and/or gravitational force, and wherein the fluids intermix at a distance of approximately 50 millimeters to approximately 300 millimeters after exiting the nozzles.

2. The dispenser bottle of claim 1 wherein the receiving containers comprise one or more polyolefins selected from the group consisting of polypropylene, polyethylene, polyvinylchloride polyethylene terephthalate, a glycol-modified polyethyleneterephthalate, or any mixture thereof.

3. The dispenser bottle of claim 1, wherein the receiving containers have the same volume and/or have a like, similar, or symmetric shapes.

4. The dispenser bottle of claims 1, wherein the receiving containers are separate structures connected by said at least one connecting web formed between the receiving containers.

5. The dispenser bottle of claim 1, wherein the receiving containers are constructed integrally with one another and have a different transparency and/or a different colouring.

6. The dispenser bottle of claim 1, wherein the nozzles are part of a nozzle head that is comprised of a stiffer material than that of the containers, to have less deformation than the containers when the containers are squeezed.

7. The dispenser bottle of claim 6, wherein the receiving containers have in cross-section in the holding region outer circumference of approximately 18 to approximately 30 centimeters.

8. The dispenser bottle of claim 1, wherein at least one of the active fluids has a viscosity 1 to 100,000 mPas or is thixotropic.

9. The dispenser bottle of claim 8, wherein at least one of the active fluids has a viscosity of 1 to 10,000 mPas.

10. The dispenser bottle of claim 9, wherein at least one of the active fluids has a viscosity of 1 to 1,000 mPas.

11. The dispenser bottle of claim 1, wherein the outlets are oriented substantially parallel to one another.

12. The dispenser bottle of claim 1, the discharge nozzles are laterally spaced approximately 5 millimeters to approximately 30 millimeters.

13. The dispenser bottle of claim 12, the discharge nozzles are laterally spaced approximately 15 millimeters to approximately 20 millimeters.

14. The dispenser bottle of claim 1, wherein the discharge nozzles include a removable closure cap.

15. The dispenser bottle of claim 14, wherein the removable closure cap has a closure plugs that enters each of the discharge nozzles.

16. The dispenser bottle of claim 14, wherein the closure caps of the discharge nozzles are formed as a single closure cap.

17. The dispenser bottle of claim 1, wherein the discharge nozzles comprise nozzle channels that are substantially non-parallel or substantially parallel to one another.

18. The dispenser bottle of claim 17, wherein the constrictions have a length in ratio to the overall length of each nozzle channel of approximately 1:2 to approximately 1:4.

19. The dispenser bottle of claim 18, wherein the overall length of each nozzle channel is approximately 2 millimeters to approximately 6 millimeters.

20. The dispenser bottle of claim 17, wherein the nozzle channels have a diameter of approximately 1.0 millimeters to approximately 4.0 millimeters.

21. The dispenser bottle of claim 1 wherein the first receiving container contains a first active fluid and the second receiving container contains a different second active fluid, wherein the first active fluid comprises one or more optionally acidic decalcifiers, optionally acidic or basic adjusted abrading agents, or mixtures thereof, and the second active fluid comprises one or more bleaches, disinfecting agents, aromatics, abrading agents, neutral cleaners, surfactants, pH indicators, dyes, or mixtures thereof.

22. The dispenser bottle of claim 1, wherein the first receiving container contains a first active fluid and the second receiving container contains a different second active fluid, wherein the first active fluid comprises one or more pretreatment agents, liquid washing agents, surfactants, or any mixture thereof, and the second active fluid comprises one or more liquid washing agents, post-treatment agents, soft rinsing agents, tumble assisting agents, bleach activators, enzymes, dyes, aromatics, optical brighteners, silver protector agents, or any mixtures thereof.

23. The dispenser bottle of claim 1, wherein the first receiving container contains a first active fluid and the second receiving container contains a different second active fluid, wherein the first active fluid comprises one or more bleaches, and the second active fluid comprises one or more enzymes, anti-corrosion agents, aromatics, polymers, nio-surfactants, dyes, bleach activators, and any mixtures thereof.

24. The dispenser bottle of claim 1, wherein the first receiving container contains a first active fluid and the second receiving container contains a different second active fluid, wherein the first active fluid comprises one or more bleaches and the second active fluid comprises one or more bleach activators, optionally combined with one or more aromatics, polymers, nio- surfactants, dyes, enzymes, or any mixtures thereof.

25. The dispenser bottle of claim 1, wherein the first receiving container contains a first active fluid and the second receiving container contains a different second active fluid, wherein the first active fluid comprises one or more peracids and the second active fluid comprises one or more enzymes combined with one or more surfactants.

26. The dispenser bottle of claim 25, wherein the first active fluid comprises 1 weight percent to 25 weight percent organic peracid.

27. The dispenser bottle of claim 25, wherein the first active fluid comprises 6-phthalimidoperoxohexanoic acid.

28. The dispenser bottle of claim 25, wherein the first active fluid has an acidic pH.

29. The dispenser bottle of claim 28, wherein the first active fluid has a pH of 2.5 to 6.

30. The dispenser bottle of claim 29, wherein the first active fluid has a pH of 3 to 5.

31. The dispenser bottle of claim 25, wherein the second active fluid contains a mixture of non-ionic and anionic surfactants.

32. The dispenser bottle of claim 25, wherein an anionic surfactant and a non-ionic surfactant are separately contained in one or the other of the second active fluid and a third active fluid contained in a third receiving container.

33. The dispenser bottle of claim 31, wherein the anionic surfactant and non-ionic surfactant are present in the second active fluid in a weight ratio of 10:1 to 1:10.

34. The dispenser bottle of claim 33, wherein the anionic surfactant and non-ionic surfactant are present in the second active fluid in a weight ratio of 7.5:1 and 1:5.

35. The dispenser bottle of claim 34, wherein the anionic surfactant and non-ionic surfactant are present in the second active fluid in a weight ratio of 5:1 and 1:2.

36. The dispenser bottle of claim 1, wherein a single active fluid or the total active fluids comprise 5 weight percent to 80 weight percent of one or more surfactants.

37. The dispenser bottle of claim 36, wherein a single active fluid or the total active fluids comprise 7.5 weight percent to 70 weight percent of one or more surfactants.

38. The dispenser bottle of claim 37, wherein a single active fluid or the total active fluids comprise 10 weight percent to 60 weight percent of one or more surfactants.

39. The dispenser bottle of claim 38, wherein a single active fluid or the total active fluids comprise 12.5 weight percent to 50 weight percent of one or more surfactants.

40. The dispenser bottle of claim 25, wherein the active fluid comprises one or more proteases, amylases, cellulases, or mixtures thereof.

41. The dispenser bottle of claim 25, wherein the second active fluid is alkaline.

42. The dispenser bottle of claim 25, wherein the first active fluid comprises a first component of a multi-phase liquid cleaning agent, and at least the second active fluid comprises a further component of said multi-phase liquid cleaning agent.

43. A dispenser bottle comprising a first receiving container for a first active fluid and at least a second receiving container for a second active fluid, wherein the two receiving containers are either separately constructed and connected together or constructed integrally with one another and wherein the receiving containers each have a respective outlet for the active fluid contained therein and the outlets are arranged adjacent to one another such that the two active fluids can be applied in a common application field of an application region, wherein the receiving containers are compressible containers, and wherein the two active fluids comprise components of a toilet cleaning agent, a cleaning agent for cleaning hard surfaces, a disinfecting agent, a washing agent, a dishwashing agent, or an anti-corrosion agent, and wherein the outlets each comprise a respective discharge nozzle, which nozzles are spaced from one another such that the active fluids intermix only after departing the discharge nozzles, wherein the nozzles each have cross-sectional constrictions arranged asymmetrically with respect to the associated nozzle cross-section to comprise means at the location of the constrictions, for increasing the flow speed of fluids being discharged through the nozzles, to impart a degree of twist to the fluids being discharged from the nozzles, wherein the receiving containers comprise a material that returns at least in part to original form after deformation, wherein the receiving containers are each formed as a complete container, connected only by at least one connecting web integrally connected at mutually facing inner sides of the receiving containers over substantially the full lengths of the receiving containers, and operating as a reinforcing means for stabilizing the mutually facing inner sides of the receiving containers and as a means for buttressing pressure forces exerted by the hand of a user when discharging active fluids from the containers, wherein the receiving containers together have a recessed holding region over a sufficiently large portion of the height of the container between vertically spaced ends to comprise means for facilitation grasping by a hand of a user for squeezing the containers and dispensing liquid from the containers.

* * * * *